US005974379A

United States Patent [19]

Hatanaka et al.

[11] Patent Number: 5,974,379

[45] **Date of Patent: *Oct. 26, 1999**

[54] METHODS AND APPARATUS FOR GAIN CONTROLLING WAVEFORM ELEMENTS AHEAD OF AN ATTACK PORTION AND WAVEFORM ELEMENTS OF A RELEASE PORTION

[75] Inventors: Mitsuyuki Hatanaka, Saitama; Yoshiaki Oikawa; Kyoya Tsutsui, both of Kanagawa, all of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/604,479

[22] Filed: Feb. 21, 1996

[30] Foreign Application Priority Data

Feb. 27, 1995 [JP] Japan ..... 7-038266

[51] Int. Cl.[6] ..... G10L 5/00

[52] U.S. Cl. ..... 704/225; 704/224; 704/229; 704/230; 704/500

[58] Field of Search ..... 395/2.34–2.39, 395/2.91; 704/224

[56] References Cited

U.S. PATENT DOCUMENTS

| | | | |
|---|---|---|---|
| 4,002,841 | 1/1977 | Ching et al. | 179/15 AS |
| 4,485,483 | 11/1984 | Torick et al. | 381/14 |
| 4,696,040 | 9/1987 | Doddington et al. | 381/46 |
| 4,704,726 | 11/1987 | Gibson | 381/13 |
| 4,972,484 | 11/1990 | Theile et al. | 381/37 |
| 5,109,417 | 4/1992 | Fielder et al. | 381/36 |
| 5,117,228 | 5/1992 | Fuchigami et al. | 341/200 |
| 5,134,658 | 7/1992 | Chen et al. | 381/46 |

(List continued on next page.)

FOREIGN PATENT DOCUMENTS

| | | | |
|---|---|---|---|
| 0 193 143 B1 | 2/1986 | European Pat. Off. | H04B 1/66 |
| 0 251 028 | 6/1987 | European Pat. Off. | H04B 1/66 |
| 0424161 A2 | 4/1991 | European Pat. Off. | G10L 9/16 |
| 0428156 A2 | 5/1991 | European Pat. Off. | H03M 7/30 |
| 0653846 A1 | 5/1995 | European Pat. Off. | H03M 7/30 |
| 63-7023 | 1/1988 | Japan | H03M 1/00 |

(List continued on next page.)

OTHER PUBLICATIONS

M. Fuma et al., "A Single Chip Decompression LSI Based on Atrac for Mini Disc", IEEE Transactions on Consumer Electronics, vol. 39, No. 3, Aug. 1993.

A. Sugiyama, et al., "Adaptive Transform Coding with an Adaptive Block Size (ATC–ABS)", C&C Systems Research Labs, NEC Corp., Kanagawa, Japan, IEEE 1990.

R.E. Crochiere, Digital Coding of Speech in Sub–bands, 55 Bell Syst. Tech J. No. 8 (1976).

(List continued on next page.)

*Primary Examiner*—David R. Hudspeth
*Assistant Examiner*—Vijay B. Chawan
*Attorney, Agent, or Firm*—Limbach & Limbach LLP

[57] ABSTRACT

A signal encoding method and apparatus for encoding input digital signals by so-called high efficiency encoding, and a recording medium having the encoded signals. An attack portion and a release portion of audio signals are detected and a gain control function is selected at least for waveform elements (waveform signals) of a signal portion ahead of the attack portion and waveform elements of the release portion from among plural gain control functions responsive to characteristics of the waveform signals. At least the waveform elements (waveform signals) ahead of the attack portion and the waveform elements of the release portion are gain controlled. The resulting gain-controlled audio signals are transformed into plural spectral components which are encoded along with the control information for gain control. With the present encoding method and apparatus, the encoding efficiency may be improved, while pre-echo and post-echo may be effectively prohibited and the sound quality may be prohibited from being deteriorated even for the high compression ratio.

32 Claims, 17 Drawing Sheets

U.S. PATENT DOCUMENTS

| | | | |
|---|---|---|---|
| 5,142,656 | 8/1992 | Fielder et al. | 381/37 |
| 5,157,760 | 10/1992 | Akagiri | 395/2 |
| 5,185,800 | 2/1993 | Mahieux | 381/29 |
| 5,241,603 | 8/1993 | Akagiri et al. | 381/37 |
| 5,264,846 | 11/1993 | Oikawa | 341/76 |
| 5,268,685 | 12/1993 | Fujiwara | 341/76 |
| 5,274,711 | 12/1993 | Rutledge et al. | 381/47 |
| 5,285,476 | 2/1994 | Akagiri et al. | 375/25 |
| 5,384,891 | 1/1995 | Asakawa et al. | 395/2.29 |
| 5,388,181 | 2/1995 | Anderson et al. | 395/212 |
| 5,394,473 | 2/1995 | Davidson | 381/36 |
| 5,410,741 | 4/1995 | Cahill et al. | 455/69 |
| 5,438,643 | 8/1995 | Akagiri et al. | 395/2.1 |
| 5,454,011 | 9/1995 | Shimoyoshi | 375/240 |
| 5,471,558 | 11/1995 | Tsutsui | 395/2.28 |
| 5,502,789 | 3/1996 | Akagiri | 395/2.13 |
| 5,515,395 | 5/1996 | Tsutsui | 375/200 |
| 5,541,600 | 7/1996 | Blumenkrantz et al. | 341/139 |
| 5,550,924 | 8/1996 | Helf et al. | 381/94 |
| 5,581,654 | 12/1996 | Tsutsui | 395/2.39 |
| 5,623,577 | 4/1997 | Fielder | 395/2.38 |
| 5,625,743 | 4/1997 | Fiocca | 395/2.14 |
| 5,632,003 | 5/1997 | Davidson et al. | 395/2.38 |
| 5,634,082 | 5/1997 | Shimoyoshi et al. | 395/2.38 |
| 5,642,111 | 6/1997 | Akagiri et al. | 341/50 |
| 5,651,089 | 7/1997 | Teh | 395/2.12 |
| 5,651,090 | 7/1997 | Moriya et al. | 395/2.31 |

FOREIGN PATENT DOCUMENTS

| | | | |
|---|---|---|---|
| 3-132228 | 6/1991 | Japan | H04B 14/00 |
| 6-334534 | 12/1994 | Japan | H03M 7/30 |
| WO 91/16769 | 10/1991 | WIPO | H04B 1/66 |

OTHER PUBLICATIONS

Joseph H. Rothweiler, "Polyphase Quadrature Filters—A New Subband Coding Technique", ICASSP 83, Boston, MA.

J.P. Princen and A.B. Bradley, "Subband Transform Coding Using Filter Bank Based on Tme Domain Aliasing Cancellation", ICASSP 1987.

M.A. Krassner, The Critical Band Encoder—Digital Encoding of the Perceptual Requirements of the Auditory System, ICASSP 1980.

IEEE Transactions of Acoustics, Speech and Signal Processing, vol. ASSP–25, No. 4, Aug. 1977.

Mahieux et al. "High Quality Audio transform Coding at 64 kbps." I.E.E.E. Transactions on Communications, vol. 42, No. 11, Nov. 1994.

METHODS AND APPARATUS FOR GAIN CONTROLLING WAVEFORM ELEMENTS AHEAD OF AN ATTACK PORTION AND WAVEFORM ELEMENTS OF A RELEASE PORTION

BACKGROUND OF THE INVENTION

1. Field of the Invention

This invention relates to a signal encoding method and apparatus for encoding input digital signals by the so-called high efficiency encoding, and a recording medium having the encoded signals recorded thereon. The invention also relates to a method for transmitting the encoded signals, and a signal decoding apparatus for decoding the encoded signals.

2. Description of the Related Art

There exist a variety of high efficiency encoding techniques of encoding audio or speech signals. Examples of these techniques include transform coding in which a frame of digital signals representing the audio signal on the time axis is converted by an orthogonal transform into a block of spectral coefficients representing the audio signal on the frequency axis, and a sub-band coding in which the frequency band of the audio signal is divided by a filter bank into a plurality of sub-bands without forming the signal into frames along the time axis prior to coding. There is also known a combination of sub-band coding and transform coding, in which digital signals representing the audio signal are divided into a plurality of frequency ranges by sub-band coding, and transform coding is applied to each of the frequency ranges.

Among the filters for dividing a frequency spectrum into a plurality of equal-width frequency ranges, there is the quadrature mirror filter (QMF) as discussed in R. E. Crochiere, Digital Coding of Speech in Sub-bands, 55 Bell Syst. Tech J. No.8 (1976). With such QMF filter, the frequency spectrum of the signal is divided into two equal-width bands. With the QMF, aliasing is not produced when the frequency bands resulting from the division are subsequently combined together.

In "Polyphase Quadrature Filters- A New Subband Coding Technique", Joseph H. Rothweiler ICASSP 83, Boston, there is shown a technique of dividing the frequency spectrum of the signal into equal-width frequency bands. With the present polyphase QMF, the frequency spectrum of the signals can be divided at a time into plural equal-width frequency bands.

There is also known a technique of orthogonal transform including dividing the digital input audio signal into frames of a predetermined time duration, and processing the resulting frames using a discrete Fourier transform (DFT), discrete cosine transform (DCT) and modified DCT (MDCT) for converting the signal from the time axis to the frequency axis. Discussions on MDCT may be found in J. P. Princen and A. B. Bradley, Subband Transform Coding Using Filter Bank Based on Time Domain Aliasing Cancellation", ICASSP 1987.

By quantizing the signals divided on the band basis by the filter or orthogonal transform, it becomes possible to control the band subjected to quantization noise and psychoacoustically more efficient coding may be performed by utilizing the so-called masking effects. If the signal components are normalized from band to band with the maximum value of the absolute values of the signal components, it becomes possible to achieve more efficient coding.

For quantizing signals split into plural frequency bands, it is known to divide the frequency spectrum into plural frequency bands taking into account the psychoacoustic characteristics of the human hearing mechanism. That is, spectral coefficients representing an audio signal on the frequency axis may be divided into a plurality of, for example, 25, critical frequency bands. The width of the critical bands increase with increasing frequency.

For encoding signals of the respective frequency bands, a pre-set number of bits are allocated from one frequency band to another, or encoding by adaptive bit allocation is performed from one frequency band to another. For example, when applying adaptive bit allocation to the spectral coefficient data resulting from MDCT, the spectral coefficient data generated by the MDCT within each of the critical bands is quantized using an adaptively allocated number of bits.

There are presently known the following two bit allocation techniques. For example, in IEEE Transactions of Acoustics, Speech and Signal Processing, vol.ASSP-25, No.4, August 1977, bit allocation is carried out on the basis of the amplitude of the signal in each critical band. This technique produces a flat quantization noise spectrum and minimizes the noise energy, but the noise level perceived by the listener is not optimum because the technique does not effectively exploit the psychoacoustic masking effect.

In the bit allocation technique described in M. A. Krassner, The Critical Band Encoder—Digital Encoding of the Perceptual Requirements of the Auditory System, ICASSP 1980, the psychoacoustic masking mechanism is used to determine a fixed bit allocation that produces the necessary signal-to-noise ratio for each critical band. However, if the signal-to-noise ratio of such a system is measured using a strongly tonal signal, for example, a 1 Khz sine wave, non-optimum results are obtained because of the fixed allocation of bits among the critical bands.

For overcoming these inconveniences, a high efficiency encoding apparatus has been proposed in which the total number of bits available for bit allocation is divided between a fixed bit allocation pattern pre-set for each small block and a block-based signal magnitude dependent bit allocation. The division ratio is set in dependence upon a signal which is relevant to the input signal, such that, the smoother the signal spectrum, the higher becomes the division ratio for the fixed bit allocation pattern, that is the smaller becomes the division ratio for block-based signal magnitude dependent bit allocation.

With this technique, if the energy is concentrated in a particular spectral component, as in the case of a sine wave input, a larger number of bits are allocated to the block containing the spectral component, for significantly improving the signal-to-noise characteristics in their entirety. Since the human auditory system is highly sensitive to a signal having acute spectral components, such technique may be employed for improving the signal-to-noise ratio for improving not only measured values but also the quality of the sound perceived by the listener.

In addition to the above techniques, a variety of other techniques have been proposed, and the model simulating the human auditory system has been refined, such that, if the encoding device is improved in its ability, encoding may be made with higher efficiency in light of the human auditory system.

If DFT or DCT is utilized as the method for transforming the waveform signal (sample data) such as the time-domain digital audio signals, into a spectral signal, a transform is executed using a time block made up of M sample data, and orthogonal transform such as DFT or DCT is carried out on the block basis. Such block-based orthogonal transform produces M independent real-number data (DFT coefficient data or DCT coefficient data). The M real-number data, thus produced, are subsequently quantized and encoded to give encoded data.

For decoding the encoded data to regenerate playback acoustic signals, the encoded data are decoded and dequantized to give real-number data, which then is inverse orthogonal-transformed by IDFT or IDCT. The resulting blocks made up of waveform element signals are linked together for regenerating acoustic signals.

The playback acoustic signals, thus generated, suffer from psychoacoustically undesirable linking distortion caused by block linking. For reducing the inter-block linking distortion, M1 sample data of both neighboring blocks are overlapped at the time of orthogonal transform by DFT or DCT.

However, if Mi sample data each are overlapped on both neighboring blocks for carrying out orthogonal transform, M sample data are produced for (M−M1) sample data on an average, so that the number of real-number data obtained on orthogonal transform is larger than the number of the original sample data employed for orthogonal transform. Since the real-number data are subsequently quantized and encoded, such increase in the number of the real-number data obtained on orthogonal transform beyond the number of the original sample data is not desirable in view of the coding efficiency.

If MDCT is employed for orthogonal transform of acoustic data consisting of sample data such as digital audio signals, orthogonal transform is carried out using 2M sample data by overlapping M sample data on both neighboring blocks, for reducing the inter-block linking distortion for producing independent M real-number data (MDCT coefficient data). In this manner, M real-number data are obtained for M sample data on an average with MDCT so that higher efficiency encoding may be realized than with DFT or DCT.

For decoding the encoded data obtained on quantizing and encoding the real-number data by MDCT for generating playback acoustic signals, the encoded data is decoded and dequantized to give real-number data which is then inverse orthogonal-transformed by IMDCT on the basis of blocks corresponding to the overlapped blocks at the time of encoding to produce in-block waveform elements. These in-block waveform elements are added together with interference for reconstructing acoustic signals.

In general, if the length of a block for orthogonal transform (size of the block along time axis) for orthogonal transform is increased, frequency resolution is improved. If the acoustic signals, such as digital audio signals, are orthogonal-transformed using such long blocks, the signal energy is concentrated in specified spectral components. On the other hand, if orthogonal transform is performed for blocks in which sufficiently long overlap is accorded in both neighboring blocks, inter-block distortion of acoustic signals may be reduced satisfactorily. If orthogonal transform is performed by MDCT on blocks in which the number of sample data equal to one-half the number of sample data of a block are overlapped between the neighboring blocks, and if the number of the real-number data obtained on orthogonal transform is not increased as compared to the number of the original acoustic signals, a higher encoding efficiency may be achieved than in the case of orthogonal transform employing DFT and DCT.

Meanwhile, if the acoustic signals are blocked and resolved on the block basis into spectral components (real-number data obtained on orthogonal transform in the previous example) and the resulting spectral components are quantized and encoded, the quantization noise is produced in the acoustic signals subsequently produced at the time of block-based synthesis.

If the original acoustic signals contain signal components with abruptly changing signal levels, that is portions with abruptly changing levels (transient portions) in the waveform elements, and such acoustic signals are encoded and subsequently decoded, the quantization noise corresponding to the transient portions is spread to portions of the original acoustic signal other than the transient portions.

It is assumed that, as audio signals to be encoded, a waveform signal SW1 is employed, in which a quasi-stationary signal FL exhibiting only slight transition and low levels is followed by an attack portion AT with abruptly increasing sound level, as a transient portion, followed in turn by a succession of high level signals, as shown in FIG. 1A. If such waveform signal SW1 is blocked in a unit time width, signal components in each block are orthogonally transformed, and the resulting spectral signal components are quantized and encoded so as to be then inverse orthogonally transformed, decoded and dequantized, there is produced a waveform signal SW1 in which a larger quantization noise QN1 ascribable to the attack portion AT is superimposed over the entire block, as shown in FIG. 1C. The result is that the larger quantization noise QN1, higher in level than the quasi-stationary signal FL, temporally previous to the attack portion AT, is produced due to the attack portion AT in the quasi-stationary signal FL, as shown in FIG. 4C. The quantization noise QN1, appearing in the quasi-stationary signal portion, temporally previous to the attack portion AT, cannot be masked by concurrent masking by the attack portion AT and hence proves hindrance to the hearing sense. Such quantization noise QN1, appearing ahead of the attack portion AT where the sound level rises abruptly, is generally termed pre-echo. For orthogonal transform of signal components in each block, the block is multiplied prior to orthogonal transform by a transform windowing function TW having a characteristic curve of being smoothly sloped at both skirt portions for prohibiting the spectral distribution from being spread over a wide range.

In particular, if waveform signals are orthogonally transformed using a long block length for improving the frequency resolution as described previously, time resolution is lowered, thus generating pre-echo continuing for a prolonged time.

If the block length for orthogonal transform is reduced, the time period of generation of the quantization noise is reduced. Thus, if the block length for orthogonal transform is reduced in the vicinity of the attack portion, the time period of generation of pre-echo may be reduced, thus diminishing the hindrance to the hearing sense caused by pre-echo.

Referring to prevention of pre-echo by reducing the block length in the vicinity of the attack portion, the block for orthogonal transform may be reduced in length in the vicinity of the transient portion, such as the attack portion AT with abruptly increased sound level, in the waveform signal SW having the quasi-stationary signal FL in addition to the attack portion AT as shown in FIG. 2A, and orthogonal transform may be applied to signal components within the short block. In this manner, the time period of generation of pre-echo may be reduced sufficiently within the short block.

If the time period of generation of pre-echo in a block can be reduced sufficiently, it becomes possible to reduce the hindrance to the hearing sense by the so-called backward masking effect by the attack portion AT. If orthogonal transform is applied to the signal components in the short block, the transform windowing function TWS as shown in FIG. 2B is applied before proceeding to orthogonal transform.

On the other hand, if the block length for orthogonal transform is reduced for the quasi-stationary signal FL and for signal portions downstream of the attack portion AT, frequency resolution is lowered thus lowering the encoding efficiency for these signal portions. Thus, it is preferred to increase the block length for orthogonal transform for these signal portions since the energy is then concentrated in particular spectral components thus raising the encoding efficiency.

Thus, in effect, the block length for orthogonal transform is selectively switched for orthogonal transform depending upon the properties of various portions of the waveform signals SW. If the block length is selectively switched in this manner, the transform windowing function is similarly switched depending upon the selected block length. For example, the transform windowing function TW is selectively switched so that a long transform windowing function TWL is applied for a block consisting of the quasi-stationary signal SL excluding the neighborhood of the attack portion AT, and a short transform windowing function TWS is applied to a short block in the neighborhood of the attack portion AT, as shown in FIG. 2B.

However, if desired to implement the method of selectively switching the block length for orthogonal transform depending upon the characteristics of the various portions of the waveform signals in an actual configuration, it becomes necessary to provide orthogonal transform means capable of dealing with orthogonal transform with blocks of different lengths in an encoding apparatus, while it also becomes necessary to provide inverse orthogonal transform means capable of dealing with inverse orthogonal transform with blocks of different lengths in a decoding apparatus.

In addition, if desired to change the block length for orthogonal transform, the number of spectral components resulting from orthogonal transform is proportional to the block length, such that, if these spectral components are grouped together in terms of critical bands as units for encoding, the number of spectral components contained in the critical bands differs with block lengths, thus complicating the subsequent encoding and decoding operations.

In short, the method of varying the block length for orthogonal transform has a drawback that both the encoding apparatus and the decoding apparatus become complex in structure.

For effectively prohibiting the generation of pre-echo in the application of the above-mentioned orthogonal transform such as DFT or DCT for resolution into frequency components, as the block length for orthogonal transform is maintained at a constant value capable of assuring sufficient frequency resolution, there is disclosed such a technique as disclosed in, for example, JP Patent Kokai Publication 61-201526 or 63-7023, corresponding to European Patent Publication Nos. 0193143 and 0251028, which are not written in English.

In these EP publications, there is disclosed a method in which an input signal waveform is sliced at an interval of a block made up of plural data samples, a windowing function is applied to each block, an attack portion is detected, waveform signals of small amplitudes directly previous to the attack portion, that is quasi-stationary signals, are amplified and orthogonal transform, such as DFT or DCT, is applied to the amplified waveform signals to produce spectral components which are encoded.

For decoding, decoded spectral components are inverse orthogonal transformed by inverse DFT (IDFT) or inverse DCT (IDCT) and correction is made for amplification performed on the signals directly ahead of the attack portion at the time of encoding. This prohibits occurrence of the pre-echo. Since the block length for orthogonal transform may be perpetually maintained constant in this manner, the encoding apparatus and the decoding apparatus may be simplified in structure.

Referring to FIGS. 3A to 3C, the operating principle of encoding and decoding employing the windowing technique disclosed in the above publications is explained.

For encoding, the waveform signal SW shown in FIG. 3A is sliced in blocks each of a pre-set length and sample data is overlapped at either ends with both neighboring blocks. The waveform signals SW in the respective blocks are multiplied with transform windowing functions TWa to TWc (FIG. 3B) for prohibiting diffusion of the spectral distribution. It is then checked if there is any attack portion AT in each block where the input waveform signal SW is abruptly increased in amplitude. In the example of FIGS. 3A and 3B, since the attack portion AT exists in the block associated with the transform windowing function TWb, the signal components in this block are multiplied with a gain control function GCb as shown at (b) in FIG. 3C for amplification. The gain control function GCb is such a function which multiplies the signal of small amplitude directly ahead of the attack portion AT in the block, that is the quasi-stationary signal FL, by R, while multiplying the signal of the remaining portion with unity. In the example of FIGS. 3A to 3C, since there is no attack portion AT in the blocks associated with the transform windowing functions TWa and TWc, the signal components in these blocks are multiplied with unity by gain control functions GCa and GCc, respectively, for not performing signal amplification. The respective blocks are orthogonally transformed by DFT or DCT to produce spectral component signals which are encoded.

For decoding, decoded spectral components are inverse orthogonally transformed by IDFT or IDCT and corrected for gain control (amplification of small-amplitude signals) performed during encoding on the signals directly ahead of the attack portion.

With the above-described conventional technique, it becomes possible to prevent the pre-echo from occurring, with the block length for orthogonal transform remaining unchanged, by the gain control operation performed during encoding on the small amplitude signals directly ahead of the attack portion and by the corresponding gain control correction performed during decoding.

With the above-described method for preventing generation of pre-echo by gain control and gain control correction, the gain control amount for the attack portion is fixed, that is, a gain control function of multiplying the signal directly ahead of the attack portion with a fixed factor R on detection of the attack portion and a gain control function of multiplying the signal with unity on detection of no attack portion, are employed, in other words, two gain control functions of fixed values are alternatively employed in dependence upon detection of presence or absence of the attack portion. Thus it is difficult to prohibit the sound quality from being deteriorated especially in case of a higher compression ratio.

Next, it is assumed that, as an audio signal to be encoded, a waveform signal SW2 shown in FIG. 4A is employed, in which a quasi-stationary signal FL with little transition and with a low signal level is followed by the attack portion AT with an abruptly rising sound level as the transient portion followed in turn by a release portion RE with abruptly decreased sound level. Such waveform signal SW2 is blocked with a unit block time width and signal components in the block are orthogonally transformed to produce spectral components which are quantized and encoded. If the resulting signals are inverse orthogonally transformed, decoded and dequantized, the resulting waveform signals SW2 is overlaid with the large quantization noise over the entire block due to the attack portion AT. Thus, the large quantization noise due to the attack portion AT appearing in the quasi-stationary signal FL temporally previous to the attack portion AT and in the release portion RE temporally posterior to the attack portion AT, as shown in FIG. 4C. This quantization noise is larger in level than the quasi-stationary signal FL or the latter portion of the release portion RE. Such quantization noise QN2F appearing in the signal portion temporally previous to the attack portion AT, that is pre-echo, and the quantization noise QN2B, appearing in the signal portion temporally posterior to the attack portion AT, cannot be masked by concurrent masking by the attack portion AT, thus proving hindrance to the hearing sense. The quantization noise QN2B appearing after the attack portion AT is generally termed post-echo. The transform windowing function TW similar to that shown in FIG. 1B is also shown in FIG. 4B.

It is possible with the technique disclosed in the prior-art system to prevent the pre-echo from occurring, while it is not possible to prevent post-echo from occurring.

SUMMARY OF THE INVENTION

It is therefore an object of the present invention to provide a signal encoding method and apparatus wherein pre-echo and post-echo may be effectively prohibited with good encoding efficiency without complicating the construction of the apparatus and wherein the encoding without deterioration in the sound quality may be assured even with the high compression ratio.

It is another object to provide a corresponding signal decoding method and apparatus, an information recording medium having the encoded signals recorded thereon, and an information transmitting method for transmitting the encoded signals.

In one aspect, the present invention provides a method for encoding a waveform signal including detecting an attack portion of the waveform signal with an abruptly increased signal level, detecting a release portion of the waveform signal with an abruptly decreased signal level, adaptively selecting the gain control amount at least for waveform elements ahead of the attack portion and waveform elements of the release portion, responsive to characteristics of the waveform signals, from among a plurality of gain control amounts, gain-controlling at least the waveform elements ahead of the attack portion and the waveform elements of the release portion, using the selected gain control amount, transforming the waveform signals into a plurality of frequency components, and encoding the control information for gain control and the frequency components.

In another aspect, the present invention provided an apparatus for decoding encoded signals for restoring waveform signals wherein the encoded signals at least comprise an encoded version of a plurality of frequency components transformed from waveform elements and an encoded version of the control correction information for gain control correction for waveform elements ahead of an attack portion with an abruptly rising signal level and for waveform elements of a release portion with an abruptly decaying signal level. The decoding apparatus includes decoding means for decoding the encoded signals in order to take out the plural frequency components and the control correction information, transform means for transforming the frequency components into waveform signals made up of plural waveform elements, means for performing gain control correction at least of the waveform elements ahead of the attack portion and the waveform elements of the release portion using the gain control correction amounts selected from among the plural gain control correction amounts on the basis of the control correction information, and means for restoring waveform signals from the waveform elements.

According to the present invention, the attack portion and the release portion are detected from the waveform signals, and the waveform elements of a signal portion ahead of the attack portion and waveform signals of the release portion are gain controlled with gain control amounts adaptively selected responsive to characteristics of the waveform signals. During decoding, the waveform elements gain-controlled during encoding are corrected for gain control performed during encoding. Thus the noise energy generated in the signal portion ahead of the attack portion and that generated in the release portion may be lowered to an imperceptible level.

DESCRIPTION OF THE PREFERRED EMBODIMENT

Figure 1A:
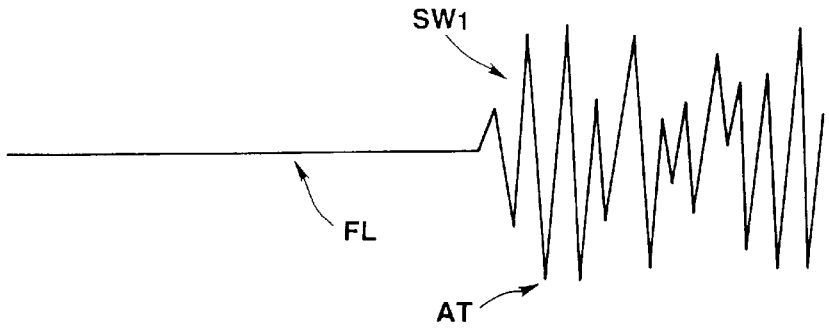
FIG.1A (PRIOR ART)
FIGS. 1A, 1B and 1C are waveforms for illustrating the principle of generation of pre-echo by transform coding.
Figure 1B:
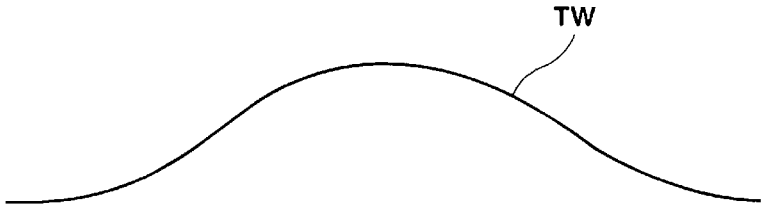
FIG.1B (PRIOR ART)
Figure 1C:
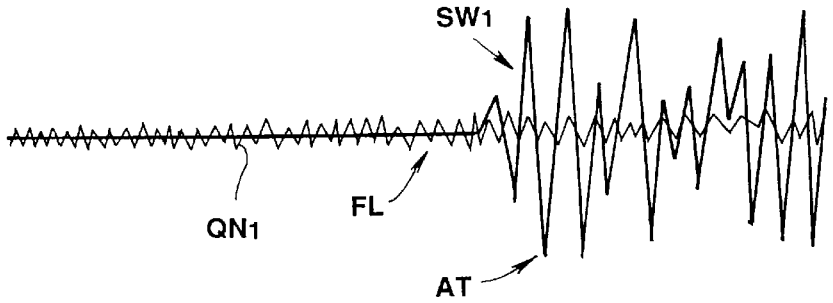
FIG.1C (PRIOR ART)
Figure 2A:
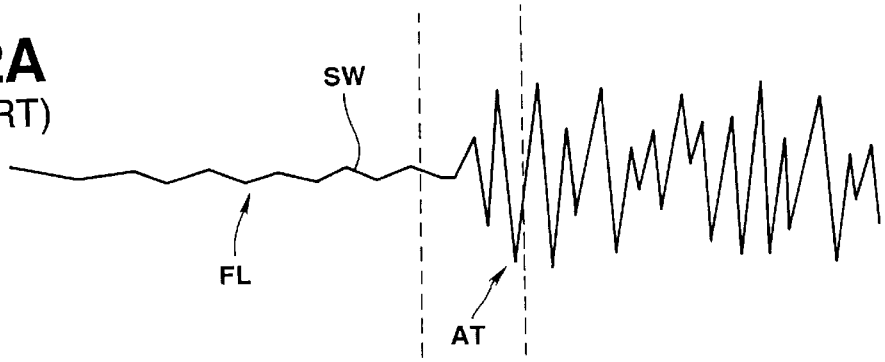
FIG.2A (PRIOR ART)
FIGS. 2A and 2B illustrate the conventional windowing technique for preventing the generation of pre-echo.
Figure 2B:
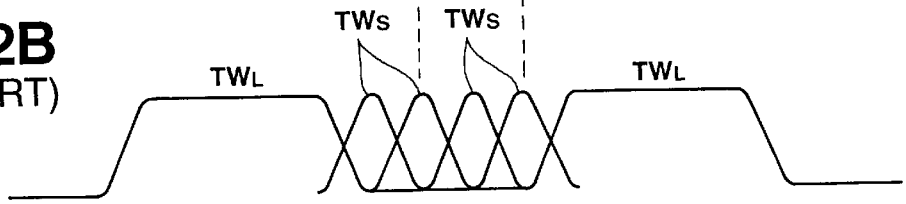
FIG.2B (PRIOR ART)
Figure 3A:
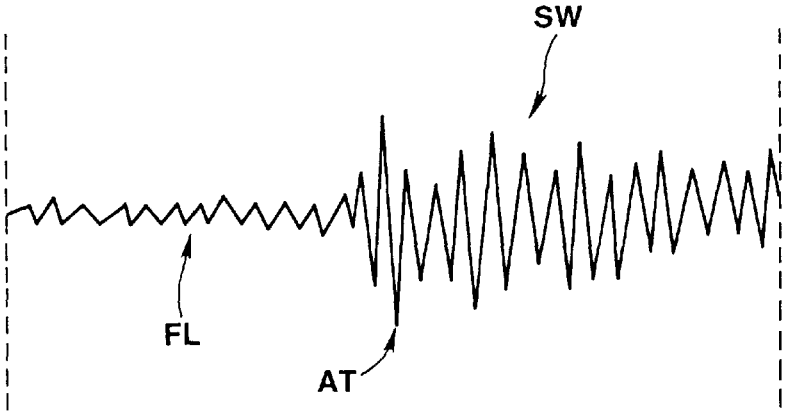
FIGS. 3A, 3B and 3C illustrate the conventional gain controlling technique for preventing the generation of pre-echo.
Figure 3B:
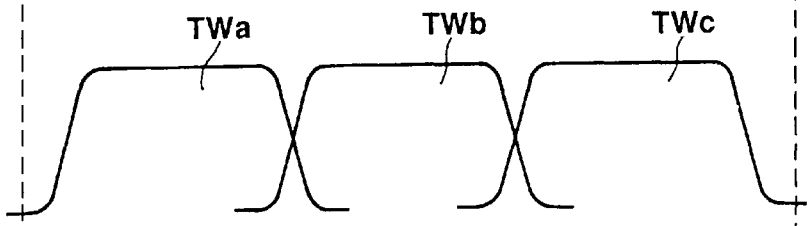
Figure 3C:
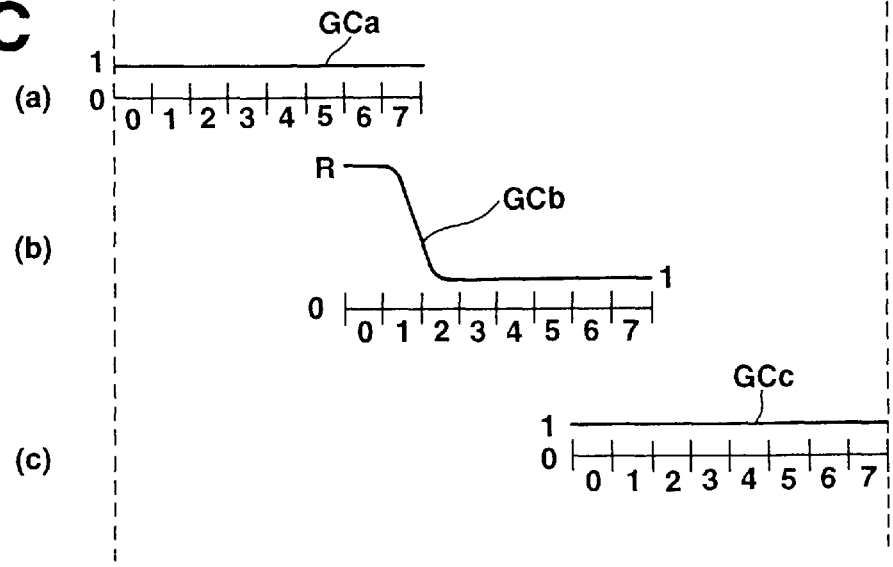
Figure 4A:
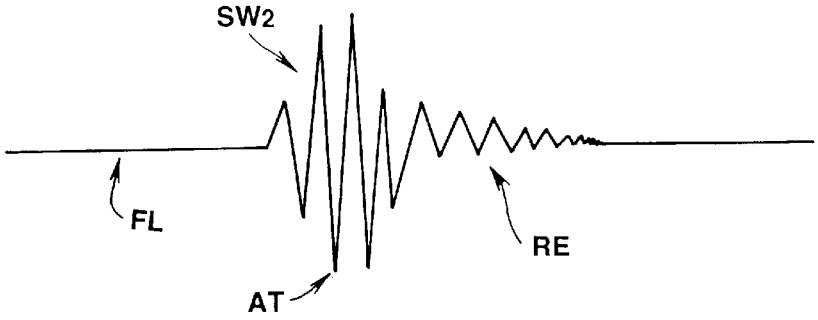
FIG.4A (PRIOR ART)
FIGS. 4A, 4B and 4C are waveforms for illustrating the principle of generation of post-echo by transform coding.
Figure 4B:
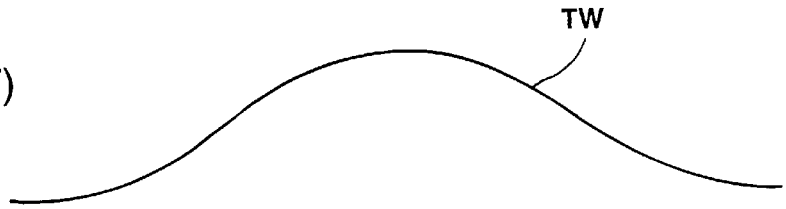
FIG.4B (PRIOR ART)
Figure 4C:
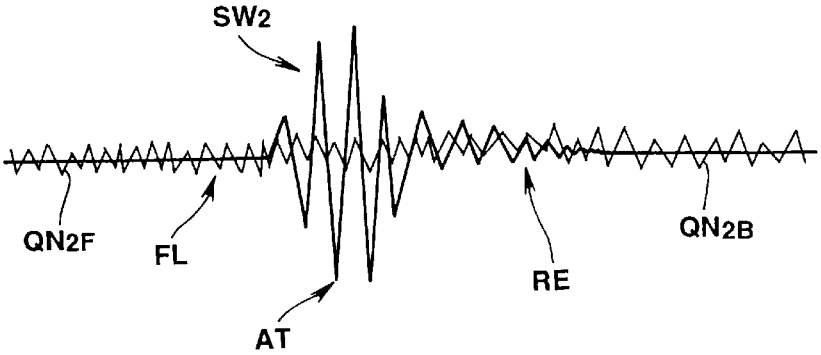

Referring to the drawings, preferred embodiments of the present invention will be explained in detail.

Figure 5:
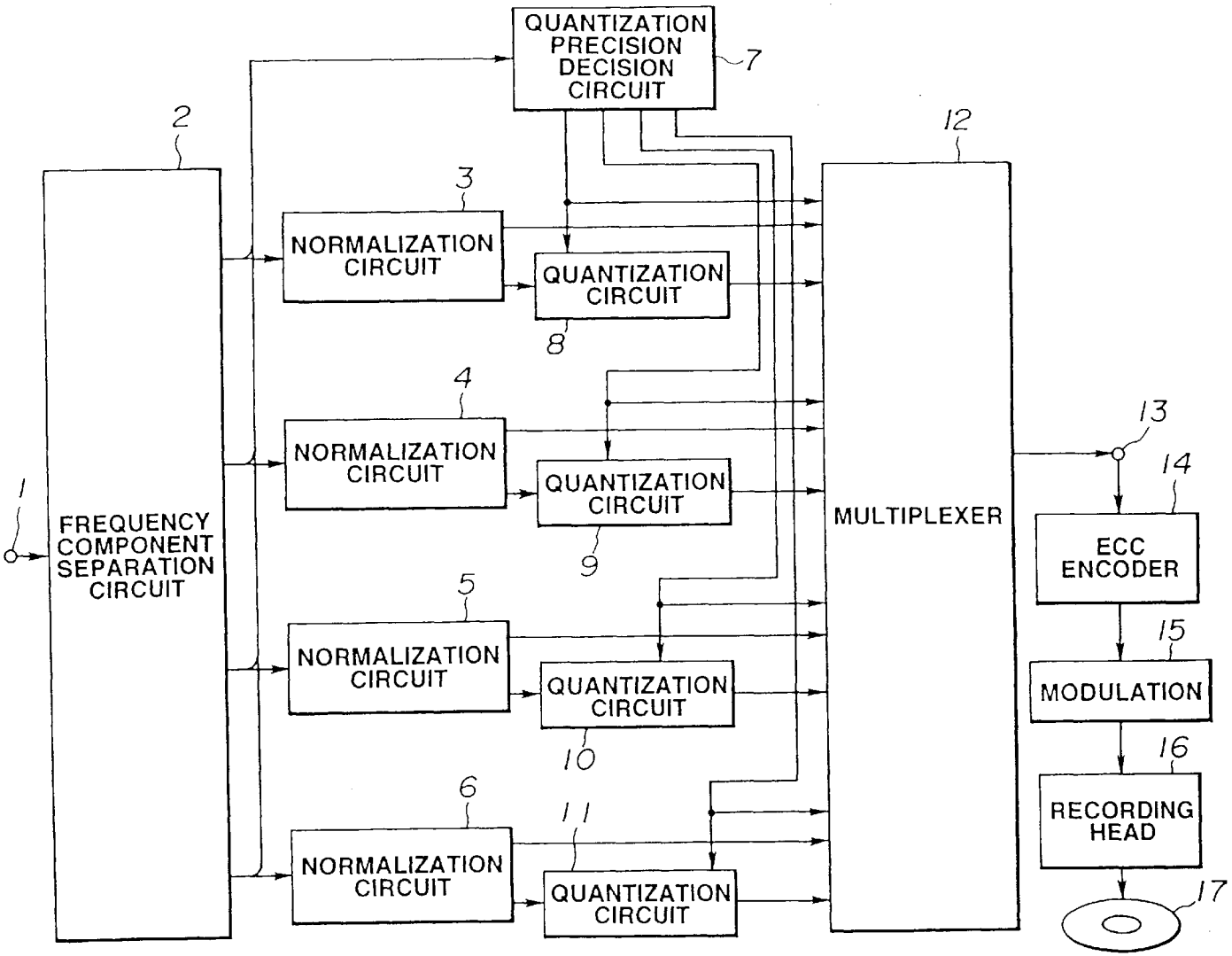
FIG. 5 is a schematic block circuit diagram showing an arrangement of an encoding apparatus according to a preferred embodiment of the present invention.

FIG. 5 illustrates a basic arrangement of an encoding apparatus for implementing the signal encoding method according to the present invention. The encoding apparatus shown in FIG. 5 includes a frequency component separation circuit 2 for dividing waveform signals into plural bands for resolution into plural frequency components, and normalization circuits 3 to 6 for normalizing frequency components of the respective bands. The encoding apparatus also includes a quantization circuit 8 for quantizing the normalized frequency components and a quantization precision decision circuit 7 for generating the quantization step information for quantization. In addition, the encoding apparatus includes a multiplexor 12 for generating a codestring signal from the quantized frequency components, normalization coefficient information for normalization and the quantization step information. In FIG. 5, there are also shown an ECC encoder 14, a modulation circuit 15 and a recording head 16 as a configuration for recording the codestring signal generated by the encoding apparatus on an optical disc 17 as an example of the information recording medium.

In FIG. 5, to an input terminal 1 is fed a digital audio signal as an acoustic signal consisting of sample data (waveform elements). This digital audio signal is resolved into frequency components by a frequency separation circuit 2. The method of resolving the digital audio signal into frequency components by the frequency component resolving circuit 2 may be enumerated by orthogonal transform, such as DFT, DCT and MDCT. With the frequency spectrum splitting by a filter, such as QMF, the digital audio signal in the time domain may be split into plural frequency components by the filter. With the orthogonal transform, time-domain digital audio signals are blocked every plural sample data and the block-based sample data are orthogonally transformed to produce frequency components (spectral components or real-number data) which then are grouped on the band basis.

With the frequency component resolution circuit 2, splitting into frequency components is performed by a method consisting in frequency spectrum splitting by a filter, such as QMF, followed by orthogonal transform. The frequency component separation circuit 2 splits the frequency spectrum of the digital audio signal supplied thereto into bands by a filter such as QMF and the frequency components of the resulting frequency bands are blocked. The blocked frequency components are orthogonally transformed using MDCT from block to block and the resulting frequency components are grouped on the band basis. The band widths of the frequency bands by the filter or the frequency components after orthogonal transform are grouped on the band basis to, for example, a uniform bandwidth, or to a non-uniform bandwidth, in agreement with, for example, the critical bandwidth. Although the frequency components produced by the frequency component separation circuit 2 are divided in the embodiment of FIG. 5 into four bands, the number may be decreased or increased, if so desired.

The frequency components of the four bands, obtained by the frequency component separation circuit 2, are sent to normalization circuits 3 to 6 provided in association with the respective bands. The normalization circuits 3 to 6 normalize the frequency components supplied thereto at an interval of a pre-set time unit. If orthogonal transform is performed in the frequency component separation circuit 2, the unit time is of the same length as the block for orthogonal transform. The normalization circuits 3 to 6 output normalized data of the normalized frequency components and normalization coefficient data specifying the normalization coefficients used for normalization. The normalized signals from the normalization circuits 3 to 6 are provided to associated quantization circuits 8 to 11, respectively. The normalization coefficient data from the normalization circuits 3 to 6 are sent to a multiplexor 12.

The quantization circuits 8 to 11 quantize the normalized data supplied from the normalization circuits 3 to 6 based upon the quantization precision (step) information supplied from a quantization precision decision circuit 7.

The frequency components of the four bands from the frequency component separation circuit 2 are also sent to the quantization precision decision circuit 7 where the quantization precision decision information sent to the quantization circuits 8 to 11 is calculated based upon the frequency components of the respective bands. The quantization precision decision information may also be calculated based upon the normalization coefficient data employed for normalization by the normalization circuits 3 to 6. The quantization precision decision information is preferably calculated by the quantization precision decision circuit 7 based upon the psychoacoustic phenomenon, such as masking effect. Since the acoustic model used in the decoder may be optionally set because the quantization precision decision information calculated by the quantization precision decision circuit 7 is also sent to the decoder, it is possible to set a model simulating a human hearing sense may be set in desired manner.

The quantized data obtained on quantizing the normalized data by the quantization circuits 8 to 11, the normalized data from the normalization circuits 3 to 6 and the quantization precision decision information from the quantization precision decision circuit 7 are supplied to the multiplexor 12. The multiplexor 12 generates a codestring from the quantized data, normalization coefficient data and the quantization step information. The codestring from the multiplexor 12 is outputted at an output terminal 13. The codestring signal outputted by the output terminal 13 is recorded on an information recording medium or transmitted via an information transmitting medium.

For recording the codestring signal on, for example, an optical disc 7, as typical of the information recording medium, the codestring signal outputted by the output terminal 13 is sent to an ECC encoder 14 where an error correction code is appended to the supplied codestring signal. An output of the ECC encoder 14 is provided to a modulation circuit 15 where it is modulated by eight-to-fourteen modulation. An output of the modulation circuit 15 is provided to a recording head 16 which then records the signal on the optical disc 17.

The information recording medium may be enumerated by a recording medium, such as a play-only optical disc or a magnetic disc, a tape-shaped recording medium, such as a magnetic tape, a semiconductor memory, or an IC card, in addition to the optical disc capable of recording and reproduction, such as the magneto-optical disc or the phase-change type optical disc. The transmission medium may be enumerated by an electrical cable or electrical wave.

Figure 6:
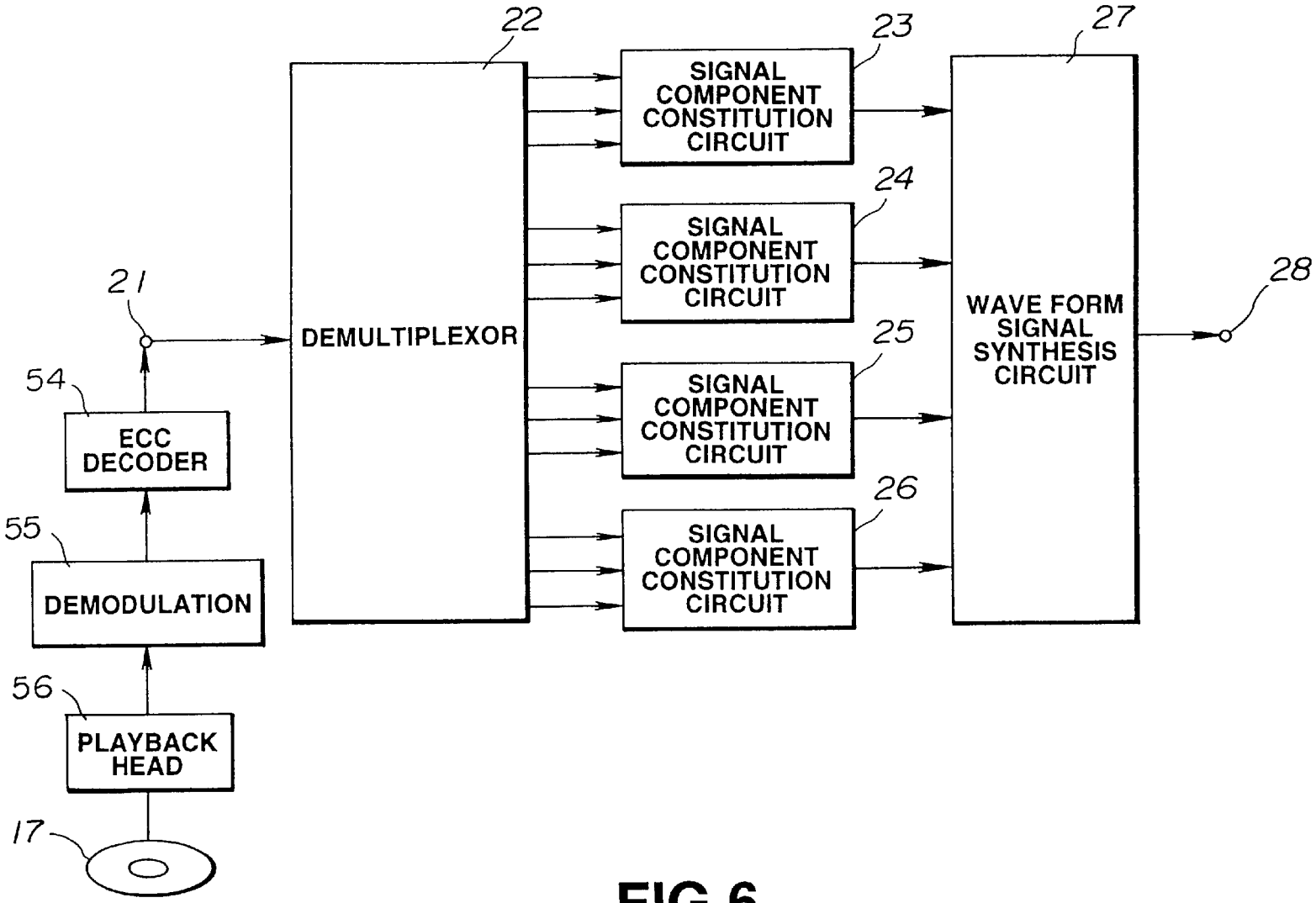
FIG. 6 is a schematic block circuit diagram showing an arrangement of a decoding apparatus according to a preferred embodiment of the present invention.

FIG. 6 shows a basic arrangement of a decoder (decoding apparatus) for decoding the codestring signal generated by the encoder shown in FIG. 5 and recorded on the information recording medium or transmitted on the transmission medium for restoring the digital audio signal. The decoding apparatus shown in FIG. 6 includes a demultiplexor 22 for taking out the quantized signal, quantization step information and the normalization coefficient information from the codestring signal, and signal component constructing circuits 23 to 26 for constitution signal components of respective bands from the quantized signal, quantization step information and the normalization coefficient information. The decoding apparatus also includes a waveform signal synthesis circuit 27 for synthesizing the signal components of the respective bands. In FIG. 6, there are also shown a playback head 56, a demodulation circuit 55 and an ECC decoder 54 as a configuration for reproducing a codestring signal recorded on the optical disc 17 as the information recording medium.

In FIG. 6, the codestring signal, reproduced from the information recording medium or transmitted via the transmitting medium, is supplied to an input terminal 21 of the decoder shown in FIG. 6. The decoder is configured for carrying out the signal decoding method according to the present invention.

The signal reproduced by a reproducing head 56 from the optical disc 17 as the information recording medium is sent to a demodulation circuit 55. The demodulation circuit 55 demodulates the eight-to-fourteen modulated signal reproduced by the reproducing head 56 from the optical disc 17. An output signal of the demodulation circuit 55 is sent to the ECC decoder 54 for error correction. The error-corrected signal is the above-mentioned codestring signal and is sent via the input terminal 21 to the demultiplexor 22. The codestring signal is made up of the quantized data, normalization coefficient data and the quantization step decision information.

The demultiplexor 22 separates the supplied codestring into the quantized data, normalization coefficient data and the quantization step decision information of the four bands explained in connection with FIG. 5. The separated quantized data, normalization coefficient data and the quantization precision decision information are sent to the signal component constitution circuits 23 to 26.

The signal component constitution circuits 23 to 26 dequantize the quantized data using the quantization precision decision information while denormalizing the dequantized data using the normalization coefficient data. The signal component constitution circuits 23 to 26 restore sample data by a reconstructing operation corresponding to the resolution into frequency components carried out by the encoder shown in FIG. 5. The sample data from the signal component constructing circuits 23 to 26 are sent to a signal synthesis circuit 27.

The signal synthesis circuit 27 synthesizes the four bands, so that the synthesized digital audio signal is outputted at the signal synthesis circuit 27. The digital audio signal is outputted at an output terminal 28 and amplified by sound radiating means, such as a speaker, headphone or an earphone, or outputted via a audio line output terminal.

In the above-described encoding apparatus, gain control and gain control correction operations are utilized for effectively prohibiting pre-echo or post-echo as the block length for orthogonal transform, such as DFT or DCT, applied for resolution into frequency components, is maintained at a constant length capable of assuring sufficient frequency resolution. In addition, the sound quality deterioration needs to be prohibited even for a high compression ratio without using one of two fixed values of the gain control functions in a one-out-of-two fashion responsive to the detection of the presence or absence of the attack portion as in the prior-art example previously explained. This is achieved by the following method according to the present invention.

First, the problem met in the method for preventing pre-echo when employing the gain control function of a fixed value explained in the prior-art example, and then the method for preventing the pre-echo from occurring in the embodiment of the present embodiment configured for coping with such problem, are explained. The method for effectively preventing post-echo from occurring in the embodiment of the present invention will also be explained.

If, in the above-described method for preventing the pre-echo from occurring in the above-explained prior-art example, the gain control amount in amplifying the small-amplitude signals directly ahead of the attack portion is of a fixed value, the following problems arise.

Figures 7A, 7B, 7C, 7D, 7E:
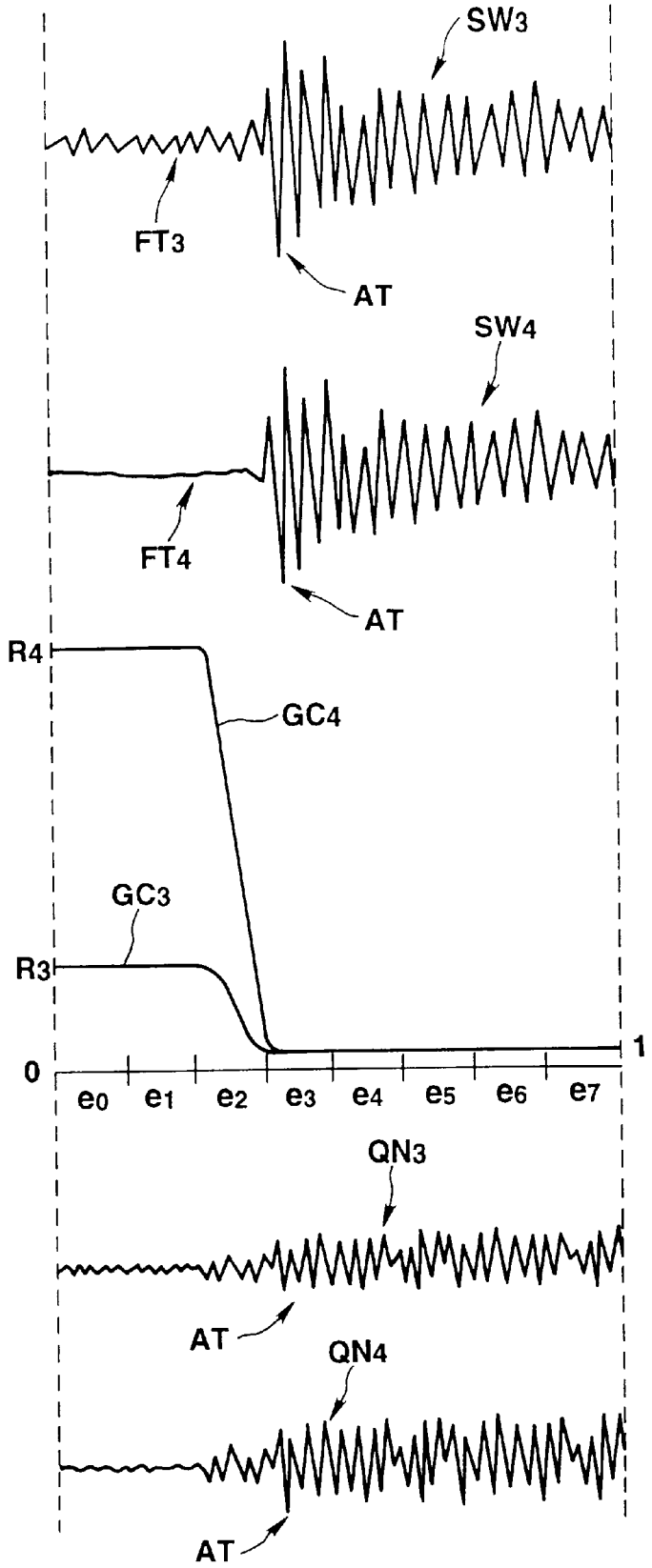
FIG.7A (PRIOR ART)
FIG.7B (PRIOR ART)
FIGS. 7A, 7B, 7C, 7D and 7E illustrate the gain control operation for the attack portion during windowing in the preferred embodiment of the invention.

If, for example, the waveform signal in a block is a waveform signal SW3 shown in FIG. 7A or a waveform signal SW4 shown in FIG. 7B, the two blocks contain attack portions AT. These waveform signals SW3 and SW4 differ in the manner of changes (transition) in signal amplitudes. That is, in the waveform signal SW3, a waveform signal FT3 having a level higher than a pre-set level is present directly ahead of the attack portion AT. In such case, the pre-echo generated ahead of the attack portion AT after encoding and subsequent decoding is masked to a certain extent by the inherent waveform signal FT3, if not so significantly as at back of the attack portion AT. Conversely, in the waveform signal SW4, a waveform signal FT4 directly ahead of the attack portion AT is low in signal level so that the pre-echo produced after encoding and decoding is hardly masked by the waveform signal FT4.

It is assumed that, as in the above-described prior-art example, the gain control functions of two fixed values are selected in a one-out-of-two fashion depending upon detection of the presence or absence of the attack portion, gain control is performed for small-amplitude signals directly ahead of the attack portion AT using a gain control function with a fixed multiplication factor of R and gain control correction is similarly performed for decoding using a fixed gain control correction function. If the gain control function (gain control amount) is set to an optimum value for the waveform signal SW3 shown in FIG. 7A, as the fixed factor for multiplication R, the pre-echo of the waveform signal SW4 shown in FIG. 7B is heard. Conversely, if the above limit value and the gain control function (gain control amount) are set to optimum values for the waveform signal SW4 shown in FIG. 7B, the pre-echo of the waveform signal SW3 is gain-controlled to more than a required extent, thus producing energy dispersion in the frequency domain and lowering the encoding efficiency.

With the encoding method according to the first embodiment of the present invention, this problem is coped with by adaptively changing the gain control amount (gain control function) depending upon the degree of amplitude changes in the signal directly ahead of the attack portion of the waveform signal.

Specifically, with the encoding method according to the first embodiment, signal components of the waveform signal SW3 directly ahead of the attack portion SW3 are gain controlled using a gain control function GC3 with a smaller value of the gain control amount (R3), while signal components of the waveform signal SW4 directly ahead of the attack portion AT are gain controlled using a gain control function GC4 with a larger value of the gain control amount (R4). The method for detecting the attack portion AT in a block and the method for selecting the gain control function for the portion directly ahead of the detected attack portion AT will be explained subsequently.

If encoding is performed with gain control as described in the first embodiment of the encoding method, using the gain control function GC3 or GC4, gain control correction corresponding to the gain control amount employed for encoding is performed during decoding.

FIGS. 7D and 7E respectively show the quantization noises QN3 and QN4 generated in the waveform signals SW3 and SW4 after encoding and decoding the waveform signal SW3 (FIG. 7A) and the waveform signal SW4 (FIG. 7B) by adaptively changing the gain control amount for the signal portion directly ahead of the attack portion in dependence upon the degree of amplitude changes produced during encoding in the attack portion and waveform signal portion directly ahead of the attack portion.

As for the quantization noise QN3 produced on encoding and decoding the waveform signal SW3, the noise suppression for the waveform signal portion directly ahead of the attack portion AT is smaller, as shown in FIG. 7D, because the gain control function GC3 in the portion directly ahead of the attack portion AT during encoding is of a smaller value (R3), and the gain control correction for decoding is of a correspondingly smaller correction value. The energy of the quantization noise QN3 for the entire block is of a smaller value. On the other hand, since the waveform signal FT3 ahead of the attack portion AT of the waveform signal SW3 is inherently of a level higher than a pre-set level, the quantization noise of the portion ahead of the attack portion is masked by the waveform signal FT3.

If the waveform signal SW4 is encoded and decoded, the energy of the quantization noise QN4 throughout the entire block is higher. However, since the gain control function GC4 for encoding in the waveform signal portion directly ahead of the attack portion AT is of a larger value (R4) and the gain control correction for decoding is of a correspondingly larger value, the quantization noise for the portion directly ahead of the attack portion AT is suppressed sufficiently, as shown in FIG. 7E.

With the first embodiment of the encoding method, described above, if the quantization noise cannot be masked by the waveform signal FT4 directly previous to the attack portion AT as in the case of the waveform signal SW4, gain control and gain control correction is perfromed in preference to suppression of the overall quantization noise energy for suppressing the pre-echo which proves serious hindrance to the hearing sense.

The gain control and gain control correction as described with reference to FIG. 7 was proposed by the present Assignee in the International Patent Application WO95/21489. The method disclosed in the patent application resides in selecting the gain control correction amount in the abruptly increasing portion of the waveform signal from plural values set on the basis of the contents of the gain control correction information found from waveform amplitudes.

In the above-described example of FIGS. 7A to 7E, the attack portion AT is present next to the quasi-stationary waveform signal FT as a waveform signal and a signal of a larger level is present next to the attack portion AT. In the present embodiment, the waveform signal is such a signal in which a quasi-stationary signal is followed by an attack portion followed in turn by a release portion with an abruptly decreasing signal level. This waveform signal is gain controlled and gain control corrected ahead and at back of the attack portion for prohibiting not only the pre-echo ahead of the attack portion but also the post-echo at back of the release portion following the release portion.

In the following explanation, waveform signals SW5 and SW6, having the attack portions AT next to quasi-stationary signals FL5 and FL6 and release portions RE5 and RE6 with abruptly decreased signal level next to the attack portions AT, are taken as an example. In the waveform signal SW5, shown in FIG. 8A, the quasi-stationary waveform signal FT5 ahead of the attack portion and the release portion RE5 at back of the attack portion are of larger levels, whereas, in the waveform signal SW6, shown in FIG. 8B, the quasi-stationary waveform signal FT6 ahead of the attack portion and the release portion RE6 at back of the attack portion are of extremely small signal levels.

Figures 8A, 8B, 8C, 8D, 8E:
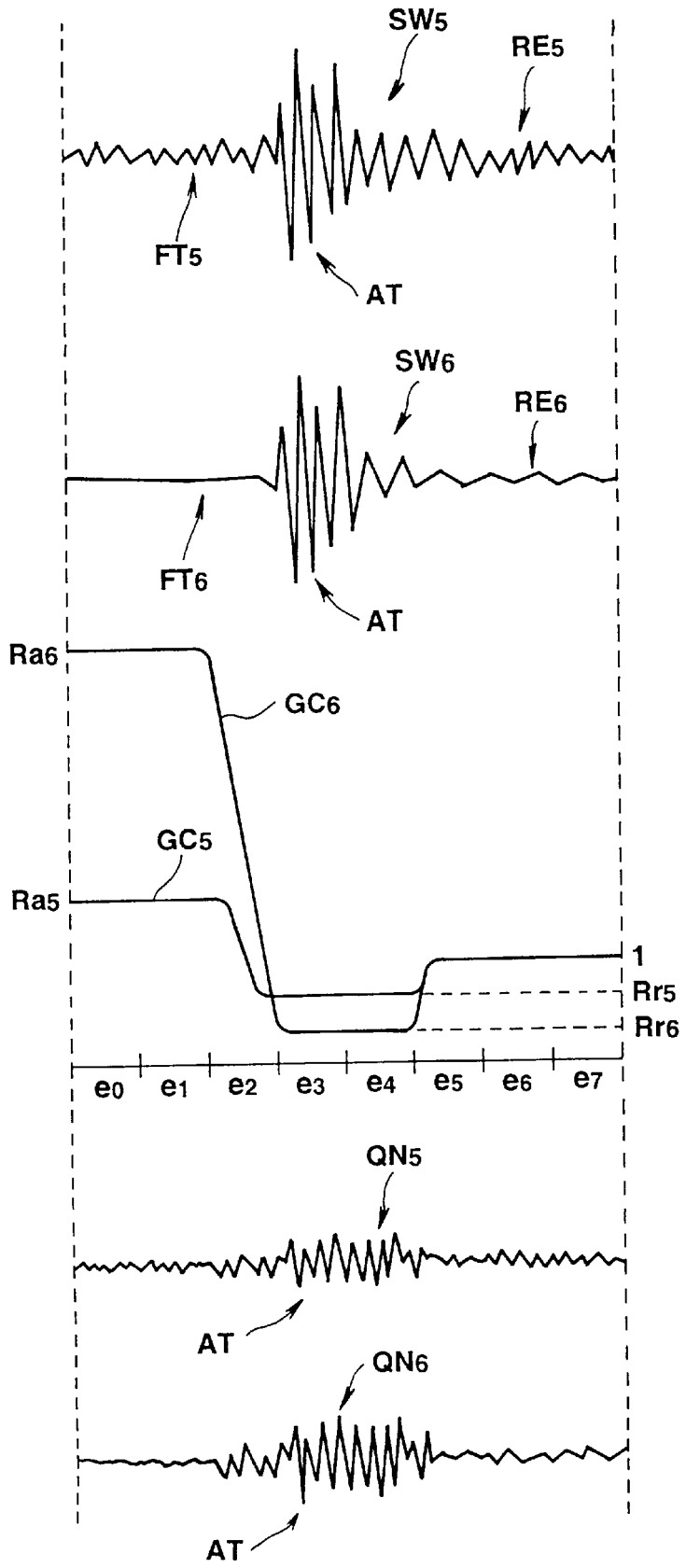
FIGS. 8A, 8B, 8C, 8D and 8E illustrate the gain control operation for the attack and release portions during windowing in the preferred embodiment of the invention.

Thus the waveform signals SW5 and SW6, shown in FIGS. 8A and 8B, both containing quasi-stationary waveform signals FT5 and FT6, attack portions AT and the release portions RE5 and RE6 in the blocks thereof, differ from each other as to the manner of signal amplitude changes, as in the example of FIGS. 7A to 7E described previously. If the gain control amounts ahead and at back of the attack portions of the waveform signals SW5 and SW6 are fixed, not only the pre-echo but also the post-echo cannot be prohibited satisfactorily for the same reason as explained previously in connection with FIG. 7. Thus, with the encoding method according to the second embodiment of the present invention, the gain control amount is adaptively changed ahead and at back of the attack portion in dependence upon the degree of signal amplitude changes ahead and at back of the attack portions of the waveform signals.

Specifically, with the encoding method of the instant embodiment, signal components directly ahead of the attack portion AT of the waveform signal SW5, that is the waveform signal FT5, is gain-controlled with a gain control amount of a smaller value (Ra5), whereas signal components RE5 at back of the attack portion AT is gain-controlled with a gain control amount (Rr5) of a smaller value less than unity, as shown in FIG. 8C. On the other hand, signal components directly ahead of the attack portion AT of the waveform signal SW6, that is the waveform signal FT6, is gain-controlled with a gain control amount of a larger value (Ra6), whereas signal components RE6 at back of the attack portion AT is gain-controlled with a gain control amount (Rr6) of a larger value less than unity. The method for detecting the attack portion AT in a block and the method for selecting the gain control function for the portion directly ahead of the detected attack portion AT will be explained subsequently.

If encoding is performed with gain control as described in the second embodiment of the encoding method, using the gain control function GC5 or GC6, gain control correction corresponding to the gain control amount employed for encoding is performed during decoding.

FIGS. 8D and 8E respectively show the quantization noises QN5 and QN6 generated in the waveform signals SW5 and SW6 after encoding and decoding the waveform signal SW5 (FIG. 8D) and the waveform signal SW6 (FIG. 8E) by adaptively changing the gain control amount for the signal portions directly ahead and at back of the attack portion in dependence upon the degree of amplitude changes produced during encoding in the waveform signal portion directly ahead and at back of the attack portion, respectively.

As for the quantization noise QN5, generated on encoding and decoding the waveform signal SW5, since the gain control function GC5 in the quasi-stationary signal FT5 ahead of the attack portion AT and in the signal of the release portion RE5 at back of the attack portion AT during encoding is of smaller gain control amounts of Ra5 and Rr5, and the gain control correction amount for the gain control correction for decoding is of a correspondingly smaller value, noise suppression in the signal portions of the quasi-stationary waveform signal FT5 and the release portion RE5 ahead and at back of the attack portion is relatively low. The energy of the quantization noise QN5 for the entire block is of a smaller value.

On the other hand, since the waveform signal FT5 ahead of the attack portion AT of the waveform signal SW5 and the signal of the release portion RE5 at back of the attack portion are inherently of a level higher than a certain value, the quantization noise in the signal portions FT5 and RE5 is masked by these signal portions. On the other hand, if the waveform signal SW6 is encoded and decoded, the energy of the quantization noise QN6 for the entire block becomes larger. However, since the gain control function GC6 in the signal portions of the quasi-stationary waveform signal FT6 and the release portion RE6 ahead and at back of the attack portion AT during encoding of larger gain control amounts of Ra6 and Rr6, and the gain control correction amount for the gain control correction for decoding is of a correspondingly larger value, the quantization noise in the quasi-stationary signal FT6 and the release portion RE6 is suppressed satisfactorily, as shown in FIG. 8E.

The pre-echo and post-echo prove serious hinderance to the human hearing sense in the second embodiment of the encoding method of the present invention, as explained in connection with FIGS. 8A to 8E. Thus, if the quantization noise cannot be masked by the signals of the waveform signals FT6 or the signals of the release portion RE6, as in the case of the waveform signal SW6, the gain control and gain control correction operations are performed for suppressing pre-echo and the post-echo in preference to suppression of the overall quantization noise energy.

Although the same types and numbers of the gain control amounts adaptively selected and applied to signals directly ahead of the attack portion and signal of the release portion may be employed, different types and numbers may be employed since the release portion is masked by concurrent masking by the attack portion more readily than the portion directly ahead of the attack portion.

Figure 9:
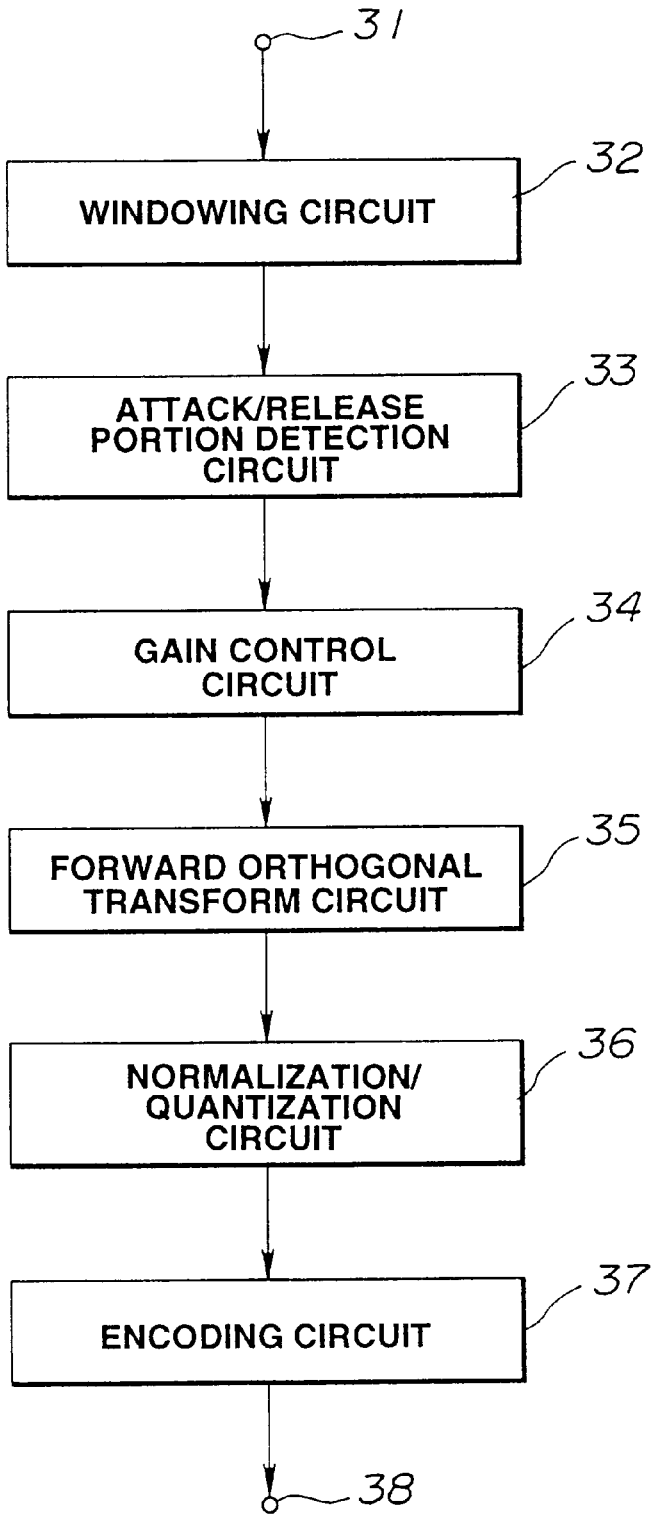
FIG. 9 is a block circuit diagram showing a detailed structure of essential portions of the encoding apparatus shown in FIG. 1.
Figure 10:
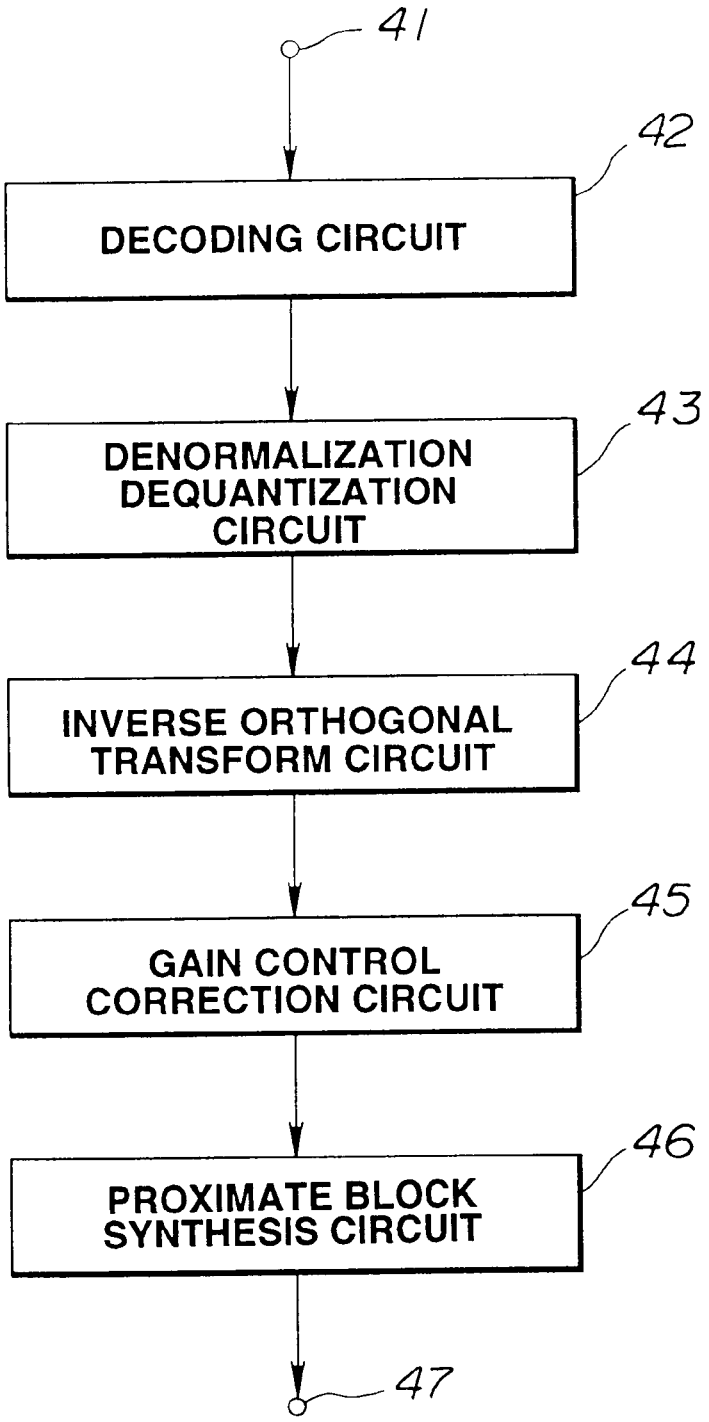
FIG. 10 is a block circuit diagram showing a detailed structure of essential portions of the decoding apparatus shown in FIG. 2.

FIGS. 9 and 10 illustrate the above-described gain control and gain control correction as applied to the above-described encoding apparatus and the decoding apparatus.

The arrangement of FIG. 9 is made up of a windowing circuit 32, an attack/release portion detection circuit 33, a gain control circuit 34, a forward orthogonal transform circuit 35, a normalization quantization circuit 36 and an encoding circuit 37. If the arrangement of FIG. 9 is compared to that of FIG. 5, the windowing circuit 32 up to the forward orthogonal transform circuit 35 are comprised in the frequency component separation circuit 2, the normalization quantization circuit 36 of FIG. 9 corresponds to the normalization circuits 3 to 6, quantization step decision circuit 7 and to the quantization circuits 8 to 11 and the encoding circuit 37 of FIG. 9 corresponds to the multiplexor 12 and the ECC encoder 14 of FIG. 5. The arrangement of FIG. 10 is made up of a decoding circuit 42, a denormalization dequantization circuit 43, an inverse orthogonal transform circuit 44, a gain control correction circuit 45 and a proximate block synthesis circuit 46. If the arrangement of FIG. 10 is compared to that of FIG. 6, the decoding circuit 42 of FIG. 10 corresponds to the ECC decoder 34 and the demultiplexor 22 of FIG. 6, the denormalization dequantization circuit 43 up to the gain control correction circuit 45 of FIG. 10 correspond to the signal component constitution circuits 23 to 26 of FIG. 6 and the proximate block synthesis circuit 46 of FIG. 10 is comprised within the waveform signal synthesis circuit 27 of FIG. 6.

Referring to FIG. 9, the waveform signal, such as the digital audio signal, is supplied to a terminal 31 and thence routed to the windowing circuit 32. The windowing circuit 32 slices the digital audio signal supplied thereto into blocks each of a pre-set length. These blocks are overlapped with the neighboring blocks and respectively multiplied with a transform windowing function.

The next attack/release portion detection circuit 33 detects whether or not there is an attack portion or a release portion in a block multiplied with a transform window function in the windowing circuit 32, and generates, on the block basis, a flag specifying the presence or absence of the attack portion and a flag specifying the presence or absence of the release portion (attack/release portion detection flag) . On detection of the attack portion, the attack/release portion detection circuit 33 generates, as the position information, the information specifying from which position in the block the attack portion begins and the information specifying from which position in the block the release portion begins, on detection of the attack portion and the release portion, respectively. If only the attack portion is detected, as explained in the encoding method of the first embodiment, the attack/release portion detection circuit 33 calculates a gain control function associated with the detected attack portion.

If the attack portion and the next following release portion are detected, as explained in connection with the encoding method of the second embodiment, the gain control function associated with the detected attack portion and the gain control function associated with the detected release portion are calculated and an ultimate gain control function is calculated from these two gain control functions. If the waveform signal in the block is the waveform signal SW3 or SW4 shown in FIGS. 7A or 7B, the calculation of the gain control function by the attack/release portion detection circuit 33 is the operation of adaptively selecting the gain control functions GC3 or GC4 as explained in connection with FIG. 7C. If the waveform signal in the block is the waveform signal SW5 or SW6 shown in FIGS. 8A or 8B, the calculation of the gain control function by the attack/release portion detection circuit 33 is the operation of adaptively selecting the gain control functions GC5 or GC6 as explained in connection with FIG. 8C.

If the attack portion or the release portion is not detected, the attack/release portion detection circuit 33 selects a gain control function specifying the gain control amount of a value equal to unity. If the attack portion or the release portion is not detected, it is also possible not to perform gain control for the block. The attack/release detection circuit 33 outputs the attack/release portion detection flag, the position information for the detected attack or release portion, the information on the selected gain control function and signal components (waveform elements) of the respective blocks to the gain control circuit 34.

If the attack/release portion detection flag supplied with the signal components in the block specifies that the attack portion in the block has been detected, the gain control circuit 34 performs a gain control operation of amplifying the small-amplitude signal ahead of the attack portion (quasi-stationary signals) in the block based upon the attack portion position information and the gain control information supplied along with the signal components in the block. Similarly, if the attack/release portion detection flag supplied with the signal components in the block specifies that the release portion in the block has been detected, the gain control circuit 34 performs the gain control operation of amplifying the small-amplitude signal ahead of the attack portion (quasi-stationary signals) in the block based upon the release portion position information and the gain control information supplied along with the signal components in the block.

That is, if the waveform signal in the gain control circuit 34 is the waveform signal SW3 or SW4 shown in FIGS. 7A and 7B, the gain control operation by the gain control circuit 34 multiplies the waveform elements in the block with the gain control functions GC3 or GC4 explained in connection with FIG. 7C. If the waveform signal in the gain control circuit 34 is the waveform signal SW5 or SW6 shown in FIGS. 8A and 8B, the gain control operation by the gain control circuit 34 multiplies the waveform elements in the block with the gain control functions GC5 or GC6 explained in connection with FIG. 8C.

If the attack/release portion detection flag indicates the absence of the attack or release portion, the gain control circuit 34 does not perform signal amplification on the signal components in the block. Specifically, the gain control circuit multiplies the waveform elements in the block with a gain control amount equal to unity for not performing the amplification. The block-based signal components (waveform elements) are provided from the gain control circuit 34 to the forward orthogonal transform circuit 35.

The forward orthogonal transform circuit 35 performs orthogonal transform, such as DFT or DCT, on the supplied block-based signal components. The resulting spectral components are provided to the normalization quantization circuit 36.

Similar to the normalization circuits 3 to 6, quantization step decision circuit 7 and the quantization circuits 8 to 11 of FIG. 5, the normalization quantization circuit 36 normalizes and quantizes the supplied spectral component signals.

The next following encoding circuit 37 sequentially generates a codestring signal, from the quantized signal, normalization coefficient information and the quantization step information, supplied from the normalization quantization circuit 36, attack/release portion detection flag, attack portion or release portion position information, in case of detection of the attack portion or the release portion, and the gain control information, and appends the error correction code to he codestring signal. An output of the encoding circuit 37 is issued at a terminal 38 and modulated by 8-to-14 modulation for recording on an information recording medium or transmission over a transmission medium.

Referring to FIG. 10, to a terminal 41 are supplied playback signals from the information recording medium, demodulated by fourteen-to-eight demodulation, or the codestring signal transmitted from the transmission medium. The codestring signal, supplied to the terminal 41, is corrected for errors by the decoding circuit 42, while being resolved into the quantized data, normalization coefficient data, normalization precision information, attack portion detection flag, attack position information in the sub-block where the attack portion has been found, and the gain control amount information. The quantized data, normalization coefficient data and the quantization precision information, from the decoding circuit 42, are sent to the denormalization dequantization circuit 43.

The denormalization dequantization circuit 43 dequantizes the quantized data, using the quantization precision information, and denormalizes the normalized data using the normalization coefficient data. This causes the denormalization dequantization circuit 43 to output spectral component signals. The spectral component signals are sent to the inverse orthogonal transform circuit 44.

The inverse orthogonal transform circuit 44 then performs inverse orthogonal transform corresponding to the orthogonal transform performed by the encoder. Specifically, if the orthogonal transform in the encoder is DFT or DCT, the inverse orthogonal transform is Inverse FDT (IDFT) or inverse DCT (IDCT).

The time-domain signals (waveform elements), obtained by inverse orthogonal transform by the inverse orthogonal transform, are sent to the gain control correction circuit 45, which is also fed with the attack portion detection flag, attack position information in the block where the attack portion has been detected, and the gain control amount information. Thus, if the small-amplitude signal of the sub-block directly previous to the attack portion in the sub-block is amplified by the gain control circuit 34 of the encoder, the gain control correction circuit 45 performs gain control correction, with the aid of the above information, for attenuating the amplified signals in the sub-block. Specifically, the gain control correction circuit 45 performs gain control correction of attenuating the small-amplitude signals of the sub-block previous to the attack portion, on the basis of the attack/release portion detection flag, specifying the presence of the attack portion or the release portion in the block; gain control amount information and the attack/release portion position information specifying the position of the attack/release portion. The gain control correction in the gain control correction circuit 45 is the operation of multiplying the signal with the gain control correction function which is a reciprocal of the gain control function employed for encoding.

Of the quantization noise spread substantially uniformly in the block at the stage of inverse orthogonal transform from the frequency domain to the time domain by the inverse orthogonal transform circuit 44, the quantization noise generated ahead and at back of the attack portion may be suppressed to a low level by attenuating the signal amplified during encoding, thus prohibiting obstructions to the hearing sense due to the pre-echo. The gain control correction circuit 45 does not perform signal attenuation on signal components in a block where there is no attack portion and hence no amplification is performed during encoding.

The signal not amplified during encoding has been multiplied with the gain control function specifying the gain control amount equal to unity, so that it is multiplied with a gain control correction function specifying the gain control correction amount corresponding to the reciprocal of unity, that is unity. The block-based signal components via the gain control correction circuit 45 are sent to the proximate block synthesis circuit 46.

The block sent to the proximate block synthesis circuit 46 is previously overlapped with neighboring blocks in the encoder. Thus the proximate block synthesis circuit 46 adds sample data in the overlapped blocks together with interference for re-constructing waveform signals (digital audio signals). The digital audio signals, re-constructed by the proximate block synthesis circuit 46, are outputted at a terminal 47 and amplified by an amplifier so as to be sent to sound radiating means, such as a speaker, headphone or an earphone, and thence outputted at an audio line output terminal.

In the method explained in connection with FIGS. 7 to 10, the signal components in the block are multiplied with the above-mentioned transform windowing function before detecting the attack portion. In such case, even if the attack portion, which is a signal portion with large amplitudes, exists in an end portion of a block, the inherent waveform signals in the block are deformed on multiplication with the transform windowing function, so that the large amplitude portion in the block end portion is attenuated and hence the attack portion can occasionally not be detected. However, the signal components of the inherent time blocks can be completely restored by orthogonal transform using DFT or DCT followed by inverse orthogonal transform. Therefore, no problem is raised if the gain control correction operation is performed on the block basis in the decoding apparatus.

Figure 11:
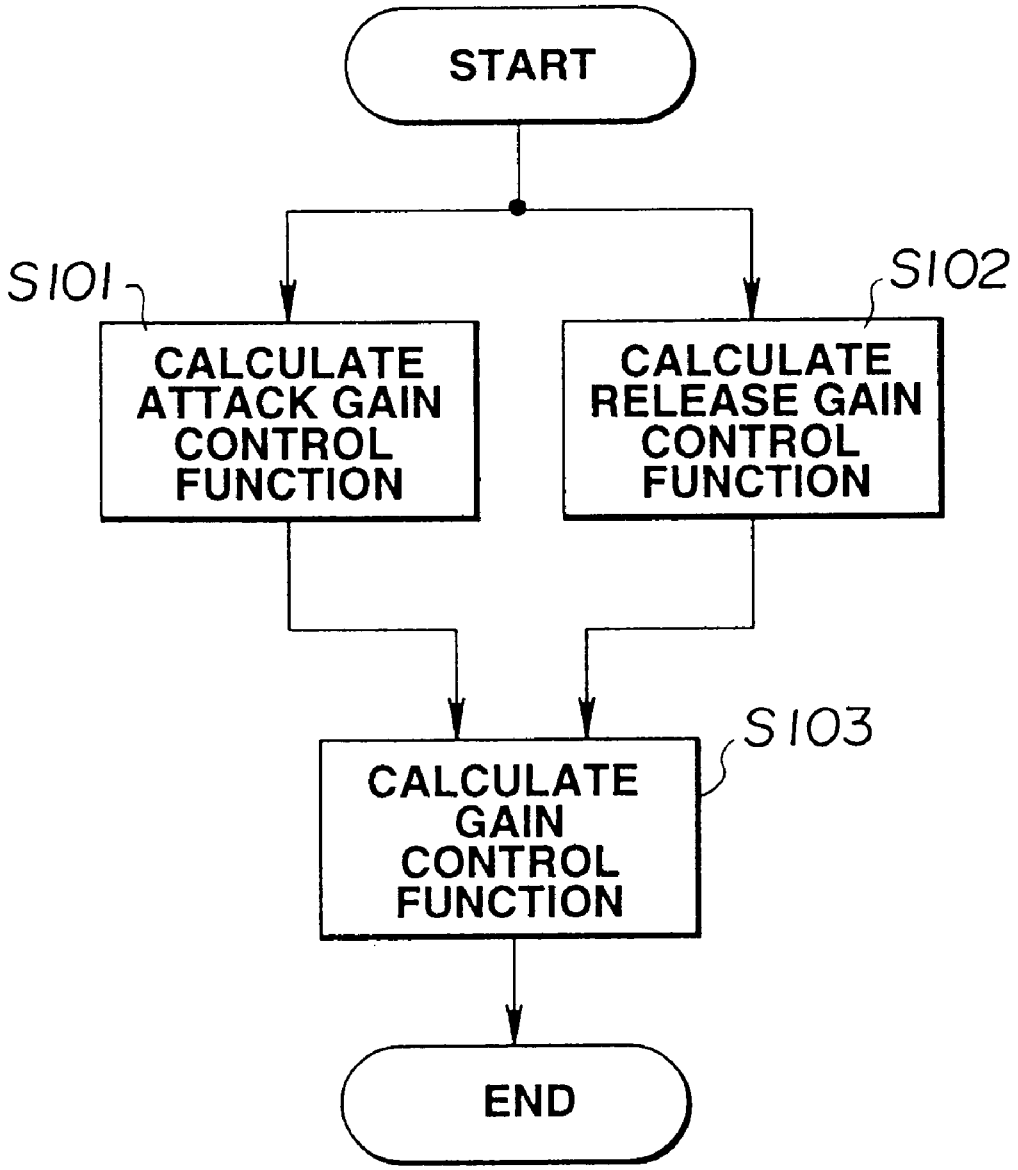
FIG. 11 is a flowchart schematically showing a typical sequence of the processing operations for generating gain control functions for the attack and release portions during encoding according to the present invention.

FIG. 11 shows an example of a processing flow for detecting an attack portion and a release portion of the waveform signal shown in FIG. 8 for generating the gain control function in the application of the above-described gain control of the instant embodiment to actual signal encoding. The processing of FIG. 11 is built into the attack/release portion detection circuit 33 shown in FIG. 9.

In FIG. 11, the attack/release portion detection circuit 33 performs at step S101 the processing of calculating the gain control function for the attack portion, while performing at step S102 the processing of calculating the gain control function for the release portion. Meanwhile, the processing of calculating the gain control function at step S101 and at step S102 is actually the processing of adaptively selecting one of pre-selected plural gain control functions in dependence upon the characteristics of the signal components in the block. At step S103, the ultimate gain control function is calculated from the gain control function for the attack portion found at step S101 and that for the release portion found at step S102.

Figure 12:
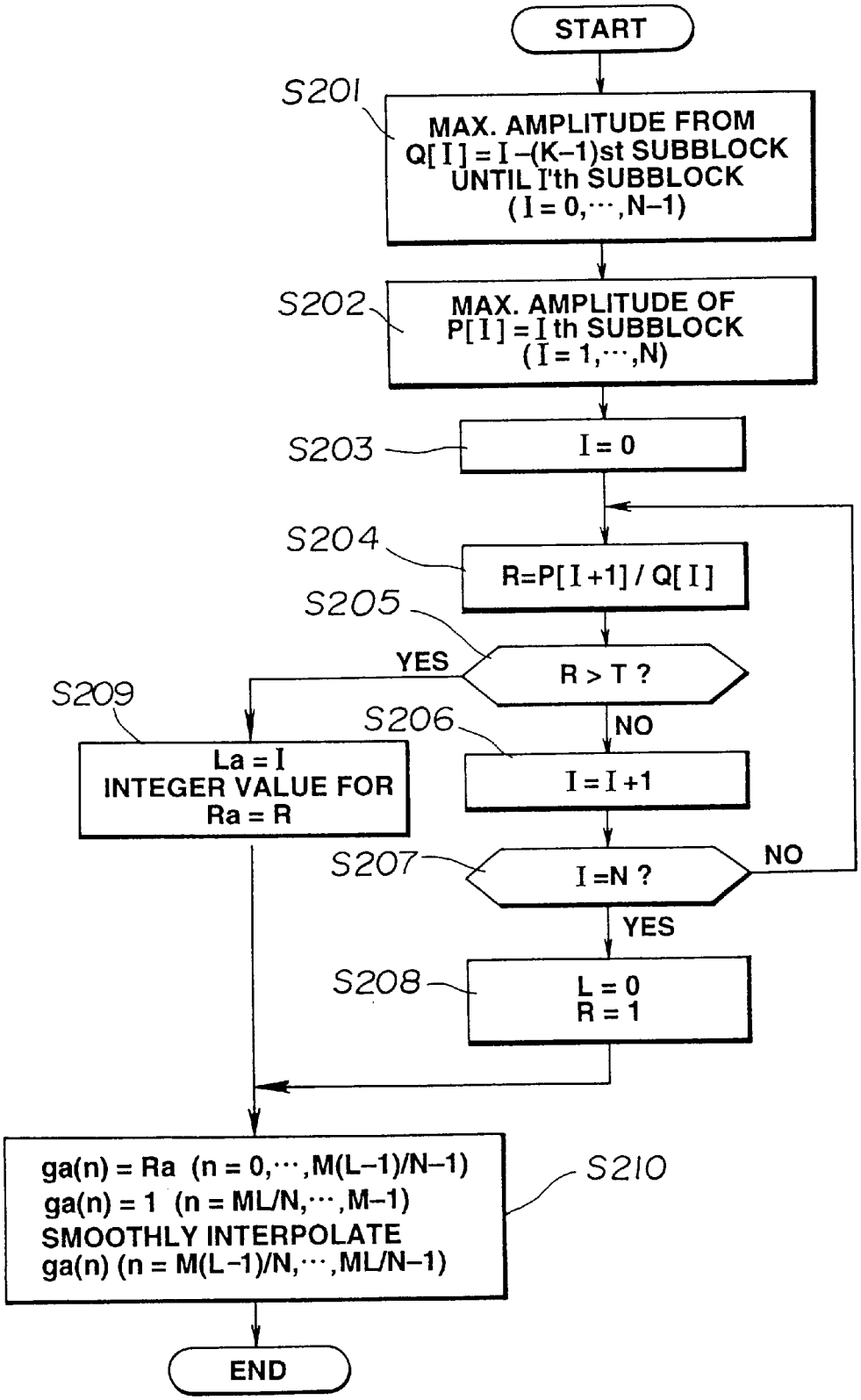
FIG. 12 is a flowchart schematically showing a typical sequence of the processing operations for generating gain control functions for the attack portion during encoding according to the present invention.

FIG. 12 shows a detailed processing flow for generating the gain control function for the attack portion at step S101 in FIG. 11.

In FIG. 12, a block having a length corresponding to 2M sample data is split into N sub-blocks, and the maximum amplitude value P[I] in the I'th sub-bock is compared to the maximum amplitude value Q[I] in K continuous sub-blocks up to the I'th sub-block. If the result specifies a ratio higher than a pre-set value, the attack portion is deemed to have been detected. In addition, a gain control function corresponding to the smoothly changing gain control amount is ultimately constructed for prohibiting energy diffusion in case of orthogonal transform of the signal components in the block.

At a first step S201 of FIG. 12, the maximum amplitude value Q[I] in K continuous sub-blocks up to I'th sub-block in N sub-blocks of a block, that is from the (I−K−1)st sub-block up to the I'th sub-block, is found. At step S202, the maximum amplitude value in the I'th sub-block P[I] is found.

At the next step S203, I is set to 0 (I=0). At step 204, the gain control amount R is found as a ratio of the maximum amplitude value Q[I] of K sub-blocks up to the I'th sub-block to the maximum amplitude value P[I+1] of the next following sub-block. At the next step S205, T is a pre-set threshold value. If R is larger than T (YES), the attack portion is deemed to have been detected, and processing transfers to step S209. If the result of decision at step S205 is NO, the processing transfers to step S206 where I is incremented by one. At step S207, it is judged whether or not I has reached the sub-block number N at the terminal end of the block. The processing as from the step S204 is repeatedly carried out until I becomes equal to N (I=N).

If the result of decision at step S207 is YES, L is set at step S208 to 0 (L=0), that is, the attack portion is deemed to be not found. Thus, R is set to 1 (R=1) and the processing transfers to step S210. If the result of detection at step S205 is YES, that is if the attack portion has been found, the processing transfers to step S209 where La is set to 1 (La=1). For R, an integer value of R as found at step S204 is substituted. That is, the length up to the attack portion in the block is construed as being the length corresponding to L sub-blocks. The corresponding value of R represents the gain control amount. After terminating the processing at step S209, the processing transfers to step S210.

At step S210, the gain control amount for the sub-blocks up to the position L of the attack portion is set to R, while interpolation is carried out for ultimately providing a smoothly changing gain control amount. The processing then comes to a close. That is, at step S210, in which the gain control function g(n) is constructed on the basis of the values of L and R, while interpolation is carried out for the sub-blocks directly ahead of the attack portion so that the gain control amount will be changed smoothly. This effectively prohibits diffusion in energy distribution for assuring highly efficient encoding in case of transform into frequency-domain signals.

By changing the gain control amount of the attack portion responsive to the level of the waveform signal, the pre-echo can be efficiently prevented from being produced even in case of a high compression ratio.

Figure 13:
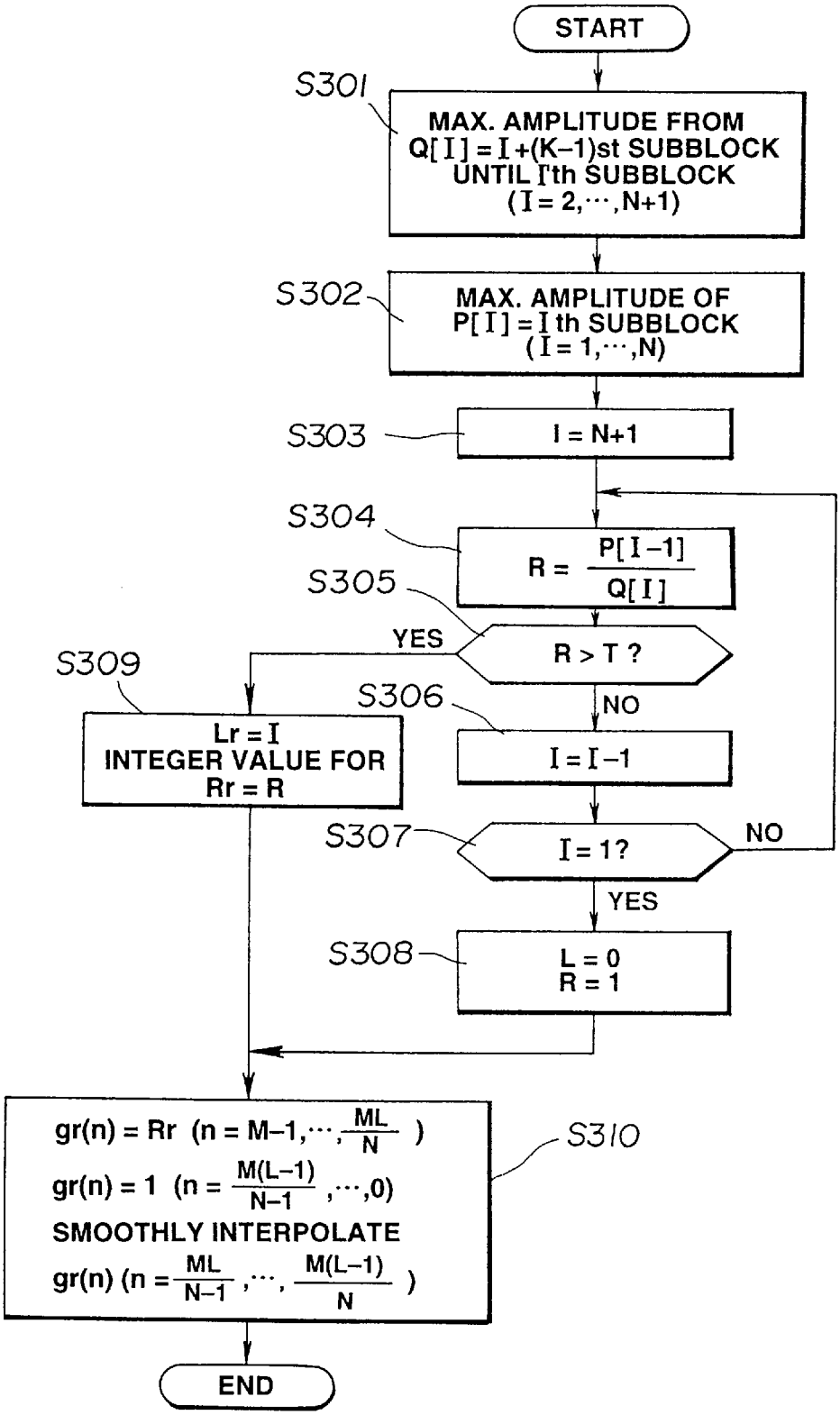
FIG. 13 is a flowchart schematically showing a typical sequence of the processing operations for generating gain control functions for the release portion during encoding according to the present invention.

FIG. 13 shows a detailed processing flow for generating the gain control function for the release portion at step S102 in FIG. 11.

In FIG. 13, a block having a length corresponding to 2M sample data is split into N sub-blocks, and the maximum amplitude value P[I] in the I'th sub-bock is compared to the maximum amplitude value Q[I] in K continuous sub-blocks up to the I'th sub-block. If the result specifies that the resulting ratio is higher than a pre-set value, the attack portion is deemed to have been detected. In addition, a gain control function corresponding to the smoothly changing gain control amount is ultimately constructed for prohibiting energy diffusion in case of orthogonal transform of the signal components in the block.

At a first step S301 in FIG. 13, the maximum amplitude value Q[I] in K contiguous sub-blocks, that is sub-blocks from I+(K−1)the sub-block up to the I'th sub-block, is found. The sub-blocks are obtained by equally dividing one block by N and the K contiguous sub-blocks are counted up to the I'th sub-block in an opposite direction to that in the case of the attack portion. At step S302, the maximum amplitude value in the I'th sub-block P[I] is found. At the next step S303, I is set to N+1. At step 304, the gain control amount R is found as a ratio of the maximum amplitude value Q[I] of K sub-blocks up to the I'th sub-block to the maximum amplitude value P[I−1] of the next following sub-block.

At the next step S305, T is a pre-set threshold value. If R is larger than T (YES), the release portion is deemed to have been detected, so that processing transfers to step S309. If the result of decision at step S305 is NO, the processing transfers to step S306 where I is decremented by one. At step S307, it is judged whether or not I has reached the first sub-block (whether or not the sub-block number is 1). If the result of step S307 is NO, the processing reverts to step S304. The processing as from the step S304 is repeatedly carried out until I becomes equal to 1 (I=1). If the result of decision at step S307 is YES, L is set at step S308 to 0 (L=0), that is, the attack portion is deemed to be not found. Thus, R is set to 1 (R=1) and the processing transfers to step S310. If the result of detection at step S305 is YES, that is if the attack portion has been found, the processing transfers to step S309 where Lr is set to I (L=I). For R, an integer value of R as found at step S304 is substituted. That is, the length of the attack portion and the downstream side portion in the block is construed as being the length corresponding to L sub-blocks. The corresponding value of R represents the gain control amount. After terminating the processing at step S309, the processing transfers to step S310.

At step S310, the gain control amount for the sub-blocks up to the position L of the attack portion is set to R, while that for the remaining portion s set to 1 and interpolation is carried out for ultimately providing a smoothly changing transient portion. The processing then comes to a close. That is, at step S310, in which the gain control function g(n) is constructed on the basis of the values of L and R, interpolation is carried out for the sub-blocks directly ahead of the attack portion so that the gain control amount will be changed in value smoothly for prohibiting diffusion in energy distribution for assuring highly efficient encoding in case of transform into the frequency-domain signals.

Figure 14:
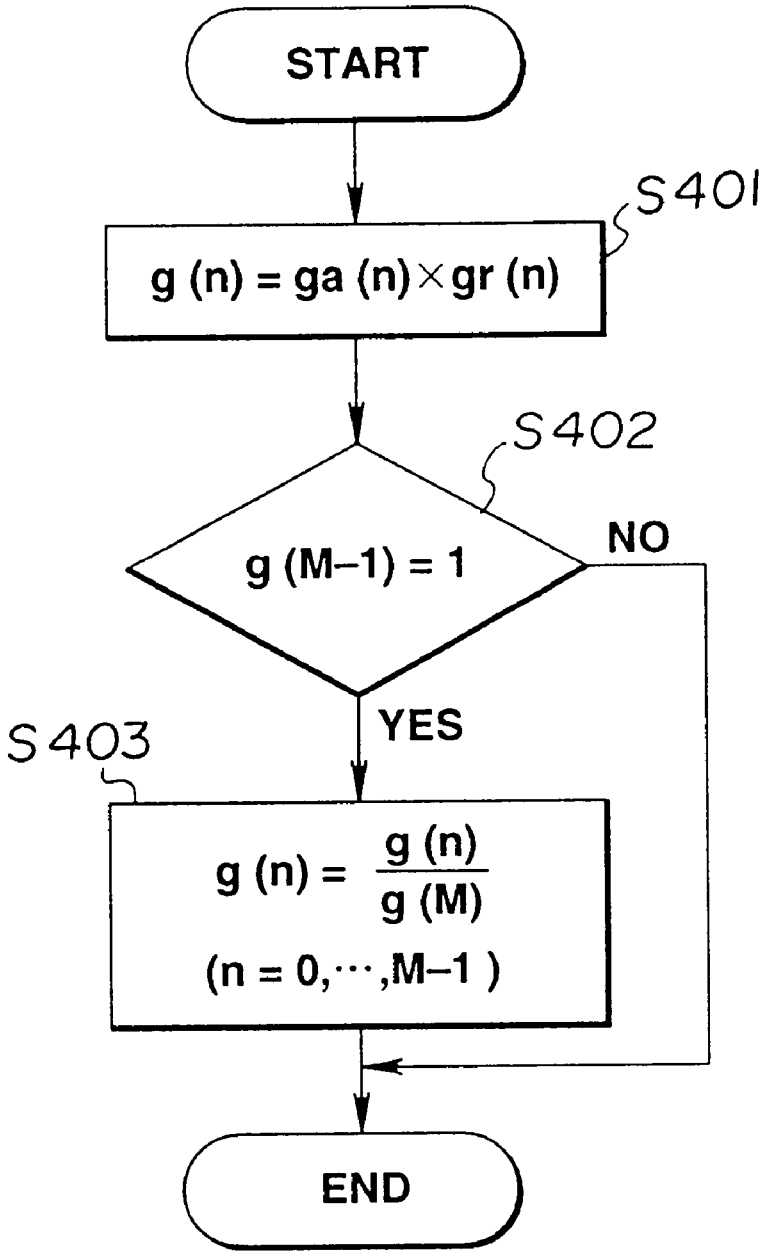
FIG. 14 is a flowchart schematically showing a typical sequence of the processing operations for synthesizing an ultimate gain control function from a gain control function for the attack portion and a gain control function for the release portion during encoding according to the present invention.

FIG. 14 shows a detailed processing for calculating the ultimate gain control function from the gain control function for the attack portion and that for the release portion at step S103 in FIG. 11.

Referring to FIG. 14, the gain control function ga(n) for the attack portion and the gain control function gr(n) for the release portion are synthesized at step S401 for finding an ultimate gain control function g(n). At the next step S402, it is judged whether or not the last value of the gain control function g(n) is a value other than unity. If the last value is found to be a value other than unity, processing transfers to step S403 and, if otherwise, processing comes to an end. At the step S403, to which the processing transfers if the last value is found at step S402 to be a value other than unity, the value is used as a division factor before the processing is brought to a close. The gain control function produced by the processing of FIG. 14 corresponds to the gain control function GC of FIG. 8.

Figures 15A, 15B, 15C, 15D:
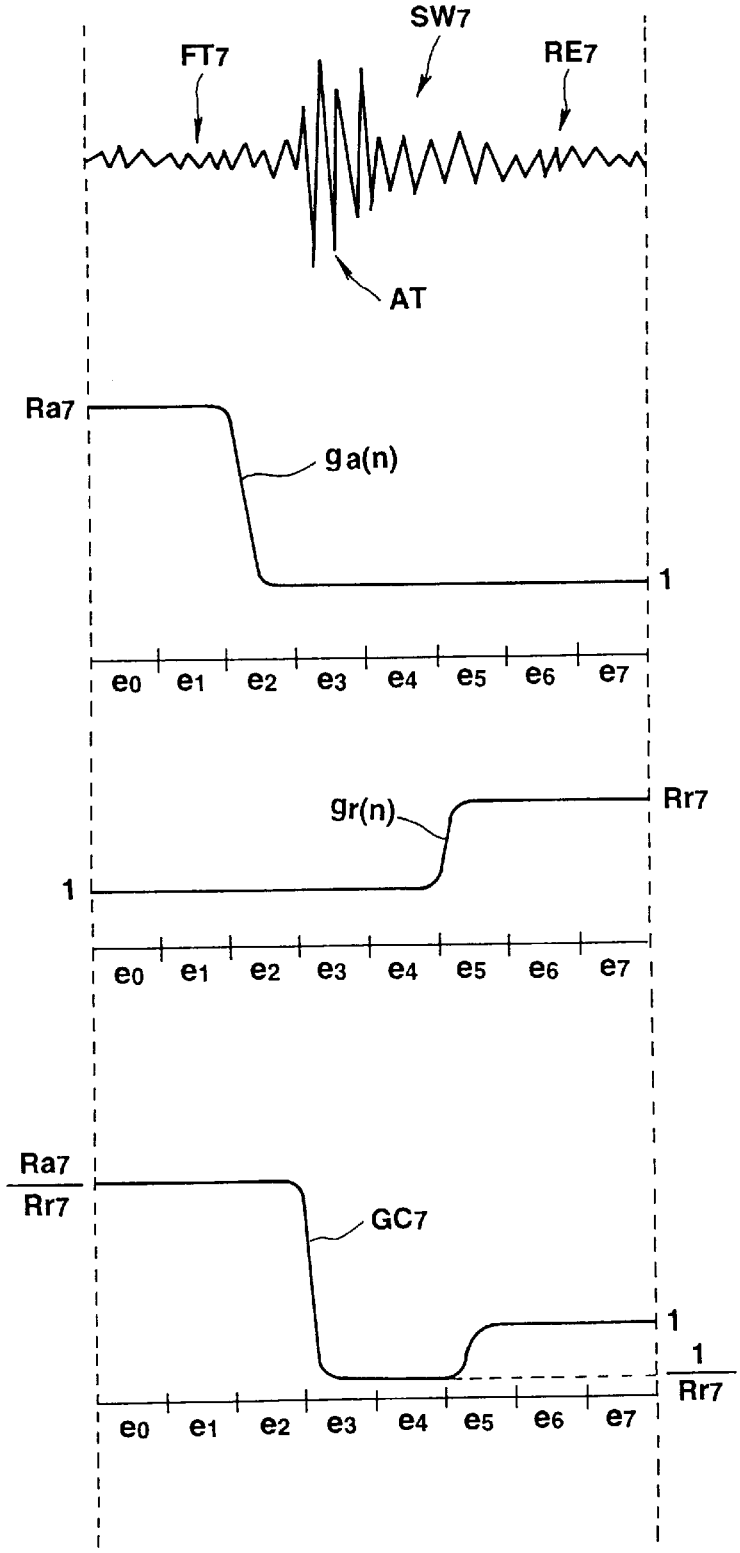
FIGS. 15A, 15B, 15C and 15D illustrate the manner of synthesizing an ultimate gain control function from a gain control function for the attack portion and a gain control function for the release portion during encoding according to the present invention.

FIGS. 15A to 15D illustrate the result of application of processing of FIGS. 11 to 14 to an actual waveform signal. FIG. 15A shows a waveform signal SW7 which is abruptly increased in signal level partway in a block and which then is abruptly decreased in signal level.

Specifically, the gain control function for the attack portion, as found from the waveform signal SW7 of FIG. 15A at step S101 of FIG. 11 (processing of FIG. 12) is such a function which multiplies the quasi-stationary signal FT7 directly ahead of the attack portion with a multiplication factor Ra7 and multiplies the remaining signal portion with a multiplication factor equal to unity, as shown in FIG. 15B. On the other hand, the gain control function for the release portion, as found from the waveform signal SW7 of FIG. 15A at step S102 of FIG. 11 (processing of FIG. 13) is such a function which multiplies the release portion RE directly at back of the attack portion with a multiplication factor Rr7 and multiplies the remaining signal portion with a multiplication factor equal to unity, as shown in FIG. 15C.

The ultimate gain control function, as found at step S103 of FIG. 11 (by the processing of FIG. 15) from the gain control function ga(n) for the attack portion and from the gain control function gr(n) for the release portion, is such a gain control function GC7 which multiplies the quasi-stationary signal portion FT7 directly ahead of the attack portion with Ra7/Rr7, then with 1/Rr7 and finally with unity, as shown in FIG. 15D.

Thus, with the instant embodiment, pre-echo ad post-echo may be effectively prohibited, even with a high compression ratio, by adaptively varying the gain control amount for the attack portion and that for the release portion depending upon the signal level.

In the foregoing description, each block is assumed to have each one attack portion and release portion. The above-described embodiment of the invention is applicable to such a case in which there exist a plurality of attack portions and a plurality of release portions.

If a gain control function which is changed abruptly in a step fashion is used, the encoding efficiency is lowered on orthogonal transform due to energy diffusion. Thus the instant embodiment employs a gain control function having a smoothly changed transient region even in the attack portion. However, the transient region with a smoothly changing signal level of the gain control function needs to be of a sufficiently short duration, otherwise the pre-echo becomes perceptible. Thus the transient region of the gain control function is preferably on the order of msecs in view of the human hearing sense and has smooth transition such as that of a sine wave.

Although an attack portion in a block is detected in the above-described embodiment, the range of detection of the attack portion may be extended to a leading sub-block of the next block in readiness for a case in which the attack portion exists in a leading end of the block next to the processed block. By extending the range of detection of the attack portion to the leading sub-block of the next block, it becomes possible to meet the condition for providing the gain control function with a smooth transition region and for assuring interference of waveform elements between neighboring blocks during inverse orthogonal transform as described above.

Figure 16:
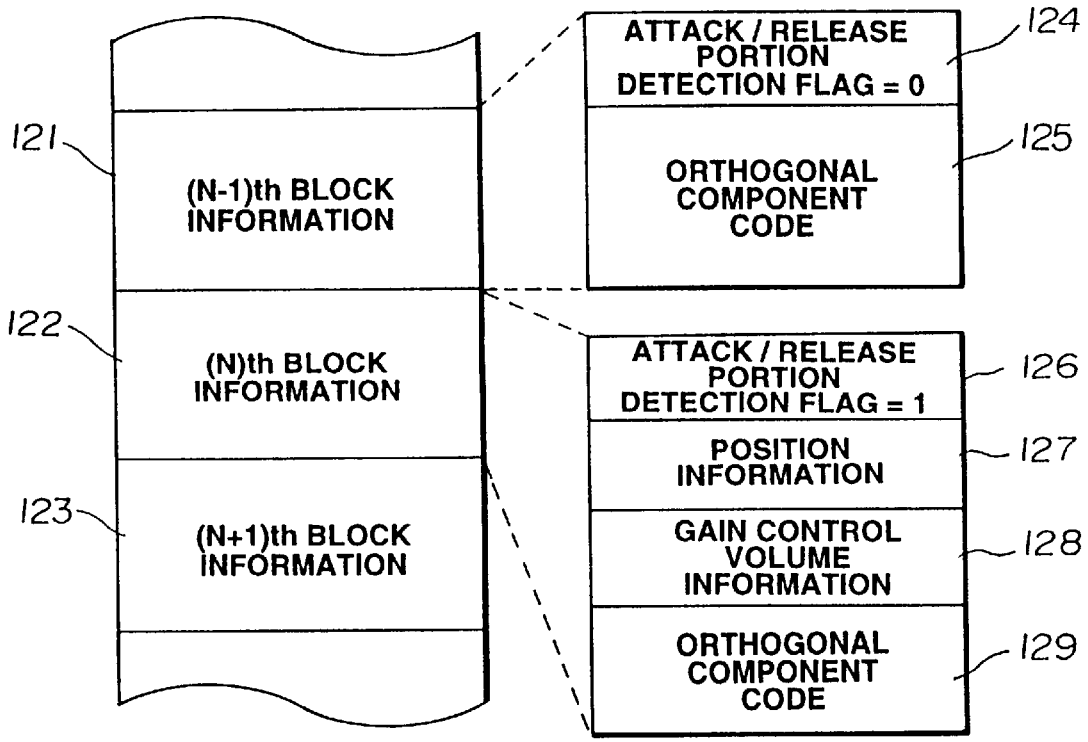
FIG. 16 shows a recording or transmission format for a codestring signal obtained by the encoding according to the present invention.

FIG. 16 shows a typical recording format for recording the codestring signal encoded in the method of the present invention on an information recording medium, or a transmission format for transmission on a transmission medium.

In FIG. 16, each block-based codestring signal (block information 121 to 123) at least has the attack/release portion detection flags 124, 126 and spectral component codes 125, 129 obtained on normalization, quantization and encoding of the spectral component signals and, depending upon the contents of the attack/release portion detection flag, the gain control correction function generating information comprising the position information for the attack portion and the release portion 127 and the gain control amount information 128. As the position information for the attack portion and the release portion 127 and the gain control amount information 128, the values of L and R employed in FIGS. 12 and 13 may be employed, respectively.

Since the ratio of the blocks where there exist attack portions subject to pre-echo is low in actual audio signals, the attack portion position information and the gain control amount information can be appended only to the block information data corresponding to the blocks where there exist the attack and release portions (the N'th block information data in the example of FIG. 16) for raising the recording efficiency for the recording medium or the transmission efficiency for the transmission medium. It is of course possible to add the gain control correction function generating information to the block information data of all blocks, in which case it is sufficient if the gain control correction function generating information is appended in the form of L=0 and R=1 within the block information data or blocks where there exist no attack portions.

Figure 17:
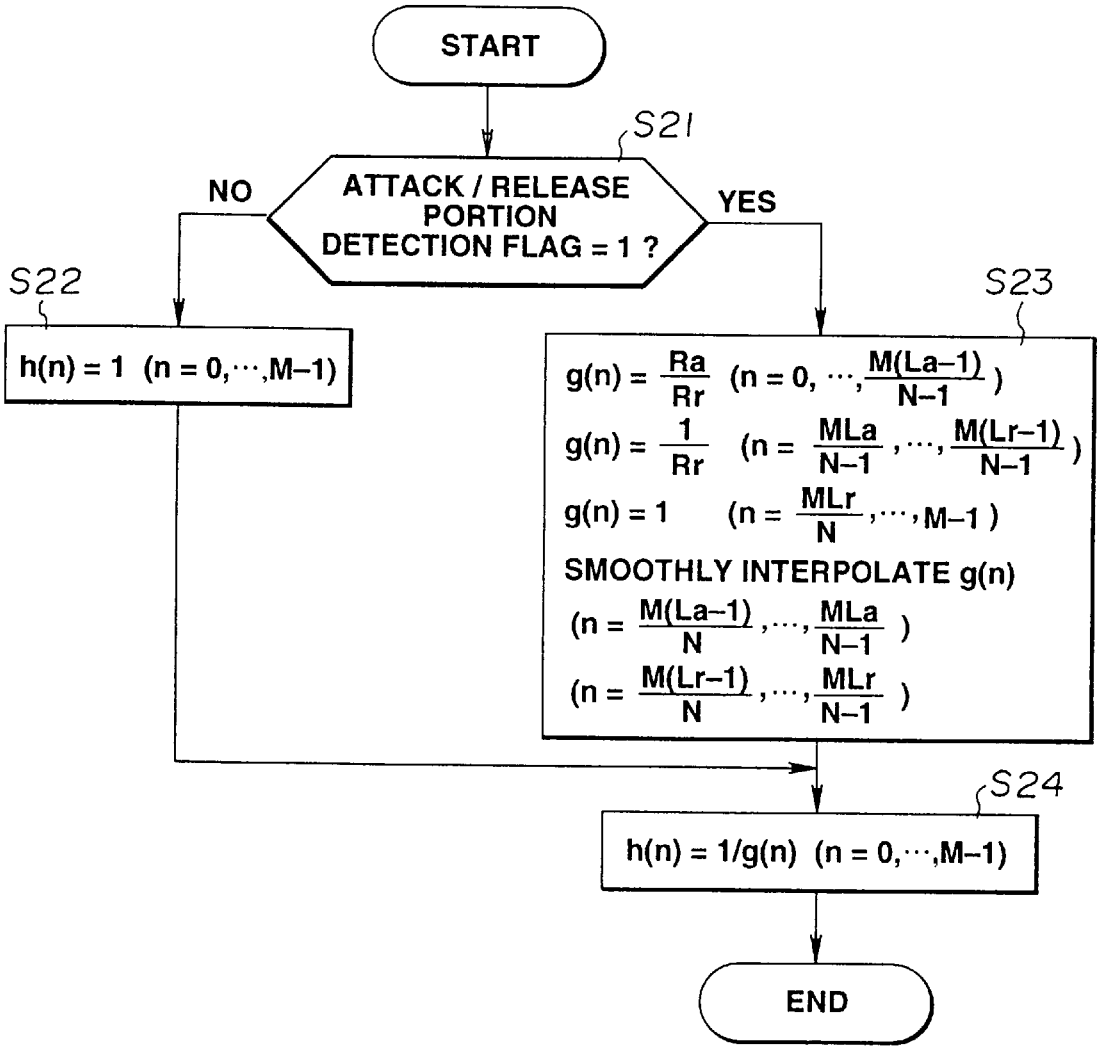
FIG. 17 is a flowchart schematically showing a typical sequence of the processing operations for generating a gain control correction function for the release portion during encoding according to the present invention.

FIG. 17 shows the processing flow for generating, by the decoding apparatus, the gain control correction function h(n) from the codestring signal explained with reference to FIG. 16. By incorporating the processing shown in FIG. 17 in the gain control correction circuit 45, the processing of FIG. 17 may be realized by the gain control correction circuit 45. In addition, signal components in the block may be regenerated by multiplying the signal component constructed by the inverse orthogonal transform in the inverse orthogonal transform circuit 44 of FIG. 10 with the gain control correction function h(n) generated by the processing of FIG. 17. Of course, the processing of multiplication of the gain control correction function h(n) may be omitted for a block where no attack portion nor release portion has been detected.

At step S21 in FIG. 17, an attack/release portion detection flag is taken out at step S21. If the attack/release portion detection flag is 0, that is if no attack portion nor release portion has been detected, processing transfers to step S22 for setting the gain control correction function h(n), that is the gain control correction amount, to 1 for terminating the processing. If the attack/release portion detection flag is 1, that is if an attack portion or a release portion has been detected, processing transfers to step S23. At step S23, as the value of the gain control function for La sub-blocks from the leading end of the block is set to Ra/Rr, while the value of the gain control function sub-blocks from (La+1) to Lr is set to 1/Rr and the value of the gain control function for the remaining sub-blocks is set to 1, the interpolation is carried out as described above for finding the ultimate gain control function g(n). At step S24, a reciprocal 1/g(n) of the gain control function g(n) is calculated for finding the gain control correction function h(n).

The method of the present invention may be applied not only to direct resolution of waveform signals by orthogonal transform into spectral components but also to resolution of signal components temporarily split by a band-splitting filter, such as QMF, into plural frequency bands into spectral components by orthogonal transform or to resolution of waveform signals into frequency signal components of plural frequency bands by a filter such as QMF. The method of the present invention may be applied to spectral components or signal components split into plural bands by a filter and, in particular, may be advantageously employed in connection with frequency components (spectral components) obtained by processing including orthogonal transform where pre-echo or post-echo presents serious problems.

In addition, the method of the present invention may be applied to an apparatus for processing digital version of the audio signals as waveform signals or to computer processing of waveform signals once arranged into a file. The method of the present invention may also be employed for recording the produced codestring signal on a recording medium or transmitting the signal on a transmission medium. Also, the method of the present invention may be applied not only to encoding at a constant bit rate at all times or to encoding with a temporally variable bit rate with the value of the bit rate being changed from one block to another.

Although the foregoing description has been made in connection with making the quantization noise less outstanding on quantization of audio signals as waveform signals, the method of the present invention may also be applied in connection with making the quantization noise less outstanding on quantization of other signals, such as picture signals or multi-channel audio signals. Since the pre-echo in the attack portion in the audio signals proves serious hindrance to the hearing sense, the present invention may be applied most effectively to the processing of audio signals.

According to the present invention, the attack portion and the release portion are detected in the waveform signals, and the waveform elements of the release portion and the portion ahead of the attack portion are encoded after gain control with a gain control amount adaptively selected responsive to characteristics of waveform signals, while the signal portion gain-controlled during encoding is corrected for gain control during decoding. Thus the energy of the noise produced in the signal portion ahead of the attack portion and in the release portion on encoding and decoding the waveform signals can be lowered to an imperceptible level, thus prohibiting generation of pre-echo or post-echo even in case of a high compression ratio and assuring highly efficient encoding, decoding and transmission with superior sound quality.

What is claimed is:

1. A method for encoding a waveform signal, the waveform signal representative of audio or video data, comprising the steps of:

detecting an attack portion of the waveform signal with an abruptly increased signal level;

detecting a release portion of the waveform signal with an abruptly decreased signal level;

adaptively selecting from among a plurality of gain control amounts a gain control amount at least for waveform elements ahead of the attack portion and waveform elements of the release portion, responsive to characteristics of the waveform signal, wherein the waveform signal is divided into a plurality of sub-blocks each having a plurality of waveform elements, and wherein the adaptive selection for each of the waveform elements ahead of attack portion and the waveform elements of the release portion of the waveform signal are based upon a respective ratio of a maximum amplitude value of continuous sub-blocks to a maximum amplitude value of a next following sub-block;

gain-controlling at least the waveform elements ahead of the attack portion and waveform elements of the release portion, using the selected gain control amount;

transforming said waveform signal into a plurality of frequency components; and encoding control information for gain control and said frequency components.

2. The encoding method as claimed in claim 1, wherein the selected gain control amount smoothly changes in value from a pre-change gain control value and to a post-change gain control value.

3. The encoding method as claimed in claim 1, wherein said attack portion is detected when the ratio of the maximum level of a given sub-block to the maximum level of plural sub-blocks ahead of said sub-block exceeds a first threshold value.

4. The encoding method as claimed in claim 1, wherein said release portion is detected when the ratio of the maximum level of a given sub-block to the maximum level of plural small-sized regions at a back of said sub-block exceeds a second threshold value.

5. The encoding method as claimed in claim 1, wherein the control information for gain controlling at least comprises the information specifying the presence or absence of the attack portion and the release portion, the information specifying the gain control amount for the waveform elements ahead of the attack portion on detection of the attack portion and the gain control amount for the waveform elements ahead of the release portion on detection of the release portion, and the information specifying the position of the attack portion on detection of the attack portion and the position of the release portion on detection of the release portion.

6. The encoding method as claimed in claim 1, wherein the processing of transforming said waveform signals into plural frequency components is the processing of blocking said waveform elements in terms of plural waveform elements as a unit and the waveform elements are orthogonally-transformed on a block basis.

7. The encoding method as claimed in claim 1, wherein, in selecting said gain control amounts, gain control amounts for the attack portion for waveform elements ahead of the attack portion are adaptively selected responsive to characteristics of the waveform signal from among the plural gain control amounts for the attack portion, gain control amounts for the release portion for waveform elements of the release portion are adaptively selected responsive to characteristics of the waveform signal from among the plural gain control amounts for the release portion, and wherein said gain control amount is selected from the selected gain control amount for the attack portion and the selected gain control amount for the release portion.

8. An apparatus for encoding a waveform signal, comprising:

means for detecting an attack portion of the waveform signal with an abruptly increased signal level;

means for detecting a release portion of the waveform signal with an abruptly decreased signal level;

means for adaptively selecting from among a plurality of gain control amounts a gain control amount at least for waveform elements ahead of the attack portion and waveform elements of the release portion, responsive to characteristics of the waveform signal, wherein the waveform signal is divided into a plurality of sub-blocks each having a plurality of waveform elements, and wherein the adaptive selection for each of the waveform elements ahead of attack portion and the waveform elements of the release portion of the waveform signal are based upon a respective ratio of a maximum amplitude value of continuous sub-blocks to a maximum amplitude value of a next following sub-block;

means for gain-controlling at least the waveform elements ahead of the attack portion and waveform elements of the release portion, using the selected gain control amount;

means for transforming said waveform signal into a plurality of frequency components; and means for encoding control information for gain control and said frequency components.

9. The encoding apparatus as claimed in claim 8, wherein said gain control means sets the selected gain control amount to smoothly change in value from a pre-change gain control value and to a post-change gain control value.

10. The encoding apparatus as claimed in claim 8, wherein said attack portion is detected when the ratio of the maximum level of a given sub-block to the maximum level of plural sub-blocks ahead of said sub-block exceeds a first threshold value.

11. The encoding apparatus as claimed in claim 8, wherein said release portion is detected when the ratio of the maximum level of a given sub-block to the maximum level of plural sub-blocks, at a back of said sub-block exceeds a second-threshold value.

12. The encoding apparatus as claimed in claim 8, wherein the control information for gain controlling at least comprises the information specifying the presence or absence of the attack portion and the release portion, the information specifying the gain control amount for the waveform elements ahead of the attack portion on detection of the attack portion and the gain control amount for the waveform elements ahead of the release portion on detection of the release portion, and the information specifying the position of the attack portion on detection of the attack portion and the position of the release portion on detection of the release portion.

13. The encoding apparatus as claimed in claim 8, wherein the processing of transforming said waveform signals into plural frequency components is the blocking of said waveform elements in terms of plural waveform elements as a unit and orthogonally-transforming waveform elements on a block basis.

14. The encoding apparatus as claimed in claim 8, wherein said selection means adaptively selects gain control amounts for the attack portion for waveform elements ahead of the attack portion responsive to characteristics of the waveform signal from among the plural gain control amounts for the attack portion, while adaptively selecting gain control amounts for the release portion for waveform elements of the release portion responsive to characteristics of the waveform signal from among the plural gain control amounts for the release portion and finding said gain control amount from the selected gain control amount for the attack portion and the selected gain control amount for the release portion.

15. A method for decoding encoded signals for restoring a waveform signal, wherein said encoded signals at least comprise an encoded version of a plurality of frequency components transformed from waveform elements and an encoded version of the control correction information for gain control correction for waveform elements ahead of an attack portion with an abruptly rising signal level and for waveform elements of a release portion with an abruptly decaying signal level, said encoded signals are decoded in order to take out the plural frequency components and the control correction information, said frequency components are transformed into waveform signals made up of plural waveform elements, comprising the steps of:

performing gain control correction at least of the waveform elements ahead of the attack portion and the waveform elements of the release portion using the gain control correction amounts selected from among said plural gain control correction amounts on the basis of the control correction information;

and restoring waveform signals from said waveform elements, wherein the control correction information is based upon a division of the waveform signal into a plurality of sub-blocks each having a plurality of waveform elements, and wherein the control correction information for each of the waveform elements ahead of attack portion and the waveform elements of the release portion of the waveform signal are based upon a respective ratio of a maximum amplitude value of continuous sub-blocks to a maximum amplitude value of a next following sub-block.

16. The signal decoding method as claimed in claim 15, wherein the gain control correction amount smoothly transitions from a pre-change gain control correction amount and to a post-change gain control correction amount.

17. The signal decoding method as claimed in claim 15, wherein the control information for gain controlling at least comprises the information specifying the presence or absence of the attack portion and the release portion, the information specifying the gain control amount for the waveform elements ahead of the attack portion on detection of the attack portion and the gain control amount for the waveform elements ahead of the release portion on detection of the release portion, and the information specifying the position of the attack portion on detection of the attack portion and the position of the release portion on detection of the release portion.

18. The signal decoding method as claimed in claim 15, wherein said frequency components are transformed into a waveform signal made up of plural waveform elements by inverse orthogonally transforming block-based frequency components for each block made up of plural frequency components.

19. An apparatus for decoding encoded signals for restoring a waveform signal, wherein said encoded signals at least comprise an encoded version of a plurality of frequency components transformed from waveform elements and an encoded version of the control correction information for gain control correction for waveform elements ahead of an attack portion with an abruptly rising signal level and for waveform elements of a release portion with an abruptly decaying signal level, comprising:

decoding means for decoding said encoded signals in order to take out the plural frequency components and the control correction information;

transform means for transforming said frequency components into waveform signals made up of plural waveform elements;

means for performing gain control correction at least of the waveform elements ahead of the attack portion and the waveform elements of the release portion using the gain control correction amounts selected from among said plural gain control correction amounts on the basis of the control correction information; and means for restoring waveform signals from said waveform elements, wherein the control correction information is based upon a division of the waveform signal into a plurality of sub-blocks each having a plurality of waveform elements, and wherein the control correction information for each of the waveform elements ahead of attack portion and the waveform elements of the release portion of the waveform signal are based upon a respective ratio of a maximum amplitude value of continuous sub-blocks to a maximum amplitude value of a next following sub-block.

20. The decoding apparatus as claimed in claim 19, wherein a gain control correction amount smoothly transitions from a pre-change gain control correction amount and to a post-change gain control correction amount.

21. The decoding apparatus as claimed in claim 19, wherein the control correction information at least comprises the information specifying the presence or absence of the attack portion and the release portion, the information specifying the gain control amount for the waveform elements ahead of the attack portion on detection of the attack portion and the gain control amount for the waveform elements ahead of the release portion on detection of the release portion, and the information specifying the position of the attack portion on detection of the attack portion and the position of the release portion on detection of the release portion.

22. The decoding apparatus as claimed in claim 19, wherein the processing for transforming said frequency components into waveform signals made up of plural waveform elements is the processing of inverse orthogonally transforming block-based frequency components for each block made up of plural frequency components.

23. An information recording medium having an encoded digital signal recorded thereon, said information recording medium for controlling a reproducing apparatus wherein at least a part of said encoded digital signal is for controlling said reproducing apparatus, said recording medium being prepared by the steps of:

detecting an attack portion of the waveform signal with an abruptly increased signal level;

detecting a release portion of the waveform signal with an abruptly decreased signal level;

adaptively selecting from among a plurality of gain control amounts a gain control amount at least for waveform elements ahead of the attack portion and waveform elements of the release portion, responsive to characteristics of the waveform signal, wherein the waveform signal is divided into a plurality of sub-blocks each having a plurality of waveform elements, and wherein the adaptive selection for each of the waveform elements ahead of attack portion and the waveform elements of the release portion of the waveform signal are based upon a respective ratio of a maximum amplitude value of continuous sub-blocks to a maximum amplitude value of a next following sub-block;

gain-controlling at least the waveform elements ahead of the attack portion and waveform elements of the release portion, using the selected gain control amount;

transforming said waveform signal into a plurality of frequency components;

encoding the control information for gain control and said frequency components; and recording the encoded control information and frequency components on the information recording medium.

24. The information recording medium as claimed in claim 23, wherein the selected gain control amount smoothly transitions from a pre-change gain control correction amount and to a post-change gain control correction amount.

25. The information recording medium as claimed in claim 23, wherein control information for gain controlling at least comprises the information specifying the presence or absence of the attack portion and the release portion, the information specifying the gain control amount for the waveform elements ahead of the attack portion on detection of the attack portion and the gain control amount for the waveform elements ahead of the release portion on detection of the release portion, and the information specifying the position of the attack portion on detection of the attack portion and the position of the release portion on detection of the release portion.

26. The information recording medium as claimed in claim 23, wherein the processing for transforming said frequency components into waveform signals made up of plural waveform elements is the processing of inverse orthogonally transforming block-based frequency components for each block made up of plural frequency components.

27. The information recording medium as claimed in claim 23, wherein said gain-control amount is found by adaptively selecting the gain control amount for the attack portion for waveform elements ahead of the attack portion responsive to characteristics of the waveform signal from among the plural gain control amounts for the attack portion, adaptively selecting gain control amounts for the release portion for waveform elements of the release portion responsive to characteristics of the waveform signal from among the plural gain control amounts for the release portion and by finding said gain control amount from the selected gain control amount for the attack portion and the selected gain control amount for the release portion.

28. An information transmission method, comprising the steps of:

transforming waveform elements into frequency components, said frequency components being obtained by transforming a gain controlled waveform signal using a gain control amount adaptively selected responsive to characteristics of the waveform signals from among a plurality of gain control amounts at least for waveform elements ahead of the attack portion where the waveform elements of the waveform signal rise abruptly in signal level and for waveform elements of the release portion where the waveform elements of the waveform signal decay abruptly in signal level, wherein the waveform signal is divided into a plurality of sub-blocks each having a plurality of waveform elements, and wherein the adaptive selection for each of the waveform elements ahead of attack portion and the waveform elements of the release portion of the waveform signal are based upon a respective ratio of a maximum amplitude value of continuous sub-blocks to a maximum amplitude value of a next following sub-block;

encoding and transmitting said frequency components; and encoding and transmitting control information for gain control.

29. The information transmission method as claimed in claim 28, wherein the selected smoothly changes in value from a pre-change gain control value and to a post-change gain control value.

30. The information transmission method as claimed in claim 28, wherein the control information for gain controlling at least comprises the information specifying the presence or absence of the attack portion and the release portion, the information specifying the gain control amount for the waveform elements ahead of the attack portion on detection of the attack portion and the gain control amount for the waveform elements ahead of the release portion on detection of the release portion, and the information specifying the position of the attack portion on detection of the attack portion and the position of the release portion on detection of the release portion.

31. The information transmission method as claimed in claim 28, wherein the processing for transforming said frequency components into the waveform signal made up of plural waveform elements is the processing of inverse orthogonally transforming block-based frequency components for each block made up of plural frequency components.

32. The information transmission method as claimed in claim 28, wherein, in selecting the gain control amount, the gain control amount for the attack portion is adaptively selected from among plural gain control amounts for the attack portion for the waveform element ahead of the attack portion responsive to characteristics of the waveform signal from among the plural gain control amounts for the attack portion, while the gain control amount for the release portion for waveform elements of the release portion is adaptively selected responsive to characteristics of the waveform signal from among the plural gain control amounts for the release portion and said gain control amount is found from the selected gain control amount for the attack portion and the selected gain control amount for the release portion.

* * * * *